US009017102B2

(12) United States Patent
Natoli

(10) Patent No.: US 9,017,102 B2
(45) Date of Patent: Apr. 28, 2015

(54) PORT ASSEMBLY CONNECTOR FOR ENGAGING A COAXIAL CABLE AND AN OUTER CONDUCTOR

(71) Applicant: John Mezzalingua Associates, Inc., East Syracuse, NY (US)

(72) Inventor: Christopher P. Natoli, Fulton, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 13/760,749

(22) Filed: Feb. 6, 2013

(65) Prior Publication Data

US 2013/0203287 A1 Aug. 8, 2013

Related U.S. Application Data

(60) Provisional application No. 61/595,614, filed on Feb. 6, 2012.

(51) Int. Cl.
*H01R 9/05* (2006.01)
*H01R 43/00* (2006.01)
*H01R 13/52* (2006.01)

(52) U.S. Cl.
CPC ..... *H01R 9/0524* (2013.01); *H01R 43/00* (2013.01); *H01R 13/5205* (2013.01)

(58) Field of Classification Search
USPC ..... 439/578, 582, 583, 584, 585
See application file for complete search history.

(56) References Cited

U.S. PATENT DOCUMENTS 3,040,288 A * 6/1962 Edlen et al. ..... 439/452
3,671,926 A * 6/1972 Zdenek Nepovim ..... 439/584
3,744,011 A * 7/1973 Blanchenot ..... 439/584
3,757,279 A * 9/1973 Winston ..... 439/584
3,764,959 A 10/1973 Toma et al.
3,910,673 A 10/1975 Stokes
3,963,321 A * 6/1976 Burger et al. ..... 439/584
4,046,451 A * 9/1977 Juds et al. ..... 439/583
4,531,805 A 7/1985 Werth
4,579,415 A 4/1986 Van Brunt et al.
4,676,577 A 6/1987 Szegda
4,696,532 A * 9/1987 Mattis ..... 439/863
4,808,128 A 2/1989 Werth
4,842,553 A * 6/1989 Ingram ..... 439/583
4,952,174 A 8/1990 Sucht et al.
5,137,470 A 8/1992 Doles (Continued)

FOREIGN PATENT DOCUMENTS

DE 4344328 C1 1/1995
EP 1858123 A2 11/2007

(Continued)

*Primary Examiner* — Ross Gushi

(74) *Attorney, Agent, or Firm* — Hiscock & Barclay LLP

(57) ABSTRACT

A port assembly comprising an outer housing having a first end and a second end, wherein the outer housing is configured to receive a coaxial cable through the second end, wherein the outer housing is configured to mate with a coupling member of a corresponding coaxial cable connector, a clamp disposed within the outer housing, the clamp including a first compression surface, a second compression surface, wherein the second compression surface opposingly corresponds to the first compression surface, and wherein the first compression surface and the second compression surface cooperate via axial compression to secure an outer conductor of the coaxial cable is provided. Furthermore, an associated method is also provided.

20 Claims, 13 Drawing Sheets

(56) References Cited

U.S. PATENT DOCUMENTS 5,154,636 A * 10/1992 Vaccaro et al. ..... 439/583
5,167,533 A 12/1992 Rauwolf
5,199,894 A 4/1993 Kalny et al.
5,322,454 A 6/1994 Thommen
5,393,244 A 2/1995 Szegda
5,397,243 A 3/1995 MacMurdo, Sr.
5,435,745 A 7/1995 Booth
5,518,420 A * 5/1996 Pitschi ..... 439/578
5,620,339 A 4/1997 Gray et al.
5,720,630 A 2/1998 Richmond et al.
5,766,037 A 6/1998 Nelson
5,795,188 A * 8/1998 Harwath ..... 439/583
5,863,220 A 1/1999 Holliday
5,938,474 A * 8/1999 Nelson ..... 439/583
5,993,254 A * 11/1999 Pitschi et al. ..... 439/584
6,019,519 A 2/2000 Grinderslev et al.
6,019,636 A 2/2000 Langham
6,032,358 A 3/2000 Wild
6,102,738 A * 8/2000 Macek et al. ..... 439/584
6,109,964 A 8/2000 Kooiman
6,123,567 A 9/2000 McCarthy
6,133,532 A * 10/2000 Lundback et al. ..... 174/88 C
6,148,513 A * 11/2000 Schiefer et al. ..... 29/858
6,183,298 B1 2/2001 Henningsen et al.
6,203,360 B1 3/2001 Harting et al.
6,206,579 B1 3/2001 Selfridge et al.
6,264,374 B1 7/2001 Selfridge et al.
6,267,621 B1 7/2001 Pitschi et al.
6,272,738 B1 8/2001 Holliday et al.
6,309,251 B1 10/2001 Tang
6,322,390 B1 * 11/2001 Takeuchi ..... 439/578
6,331,123 B1 12/2001 Rodrigues
6,383,019 B1 * 5/2002 Wild ..... 439/578
6,386,915 B1 * 5/2002 Nelson ..... 439/584
6,471,545 B1 10/2002 Hosler, Sr.
6,478,618 B2 11/2002 Wong
6,494,743 B1 12/2002 Lamatsch et al.
6,569,565 B2 5/2003 Ligeois et al.
6,607,398 B2 8/2003 Henningsen
6,733,336 B1 5/2004 Montena et al.
6,840,803 B2 1/2005 Wlos et al.
6,878,049 B2 4/2005 Heidelberger et al.
6,884,113 B1 4/2005 Montena
6,884,115 B2 4/2005 Malloy
6,939,169 B2 9/2005 Islam et al.
6,955,562 B1 * 10/2005 Henningsen ..... 439/578
6,976,872 B1 * 12/2005 Wild et al. ..... 439/578
7,008,264 B2 * 3/2006 Wild ..... 439/578
7,021,965 B1 4/2006 Montena
7,029,304 B2 4/2006 Montena
7,029,326 B2 4/2006 Montena
7,070,447 B1 7/2006 Montena
7,077,699 B2 7/2006 Islam et al.
7,077,700 B2 * 7/2006 Henningsen ..... 439/583
7,086,897 B2 8/2006 Montena
7,104,839 B2 * 9/2006 Henningsen ..... 439/578
7,108,547 B2 9/2006 Kisling et al.
7,112,093 B1 9/2006 Holland
7,121,883 B1 10/2006 Petersen et al.
7,128,603 B2 * 10/2006 Burris et al. ..... 439/578
7,131,868 B2 11/2006 Montena
7,156,560 B2 1/2007 Seeley
7,156,696 B1 1/2007 Montena
7,163,420 B2 1/2007 Montena
7,189,114 B1 * 3/2007 Burris et al. ..... 439/578
7,189,115 B1 3/2007 Montena
7,207,838 B2 4/2007 Andreescu
7,261,581 B2 * 8/2007 Henningsen ..... 439/350
7,264,502 B2 9/2007 Holland
7,278,854 B1 10/2007 Robinette et al.
7,303,435 B2 12/2007 Burris et al.
7,309,255 B2 12/2007 Rodrigues
7,335,059 B2 * 2/2008 Vaccaro et al. ..... 439/578
7,347,729 B2 3/2008 Thomas et al.
7,351,101 B1 4/2008 Montena
7,357,672 B2 4/2008 Montena
7,364,462 B2 * 4/2008 Holland ..... 439/584
7,371,112 B2 * 5/2008 Burris et al. ..... 439/578
7,458,851 B2 12/2008 Montena
7,465,190 B2 * 12/2008 Henningsen ..... 439/578
7,497,729 B1 * 3/2009 Wei ..... 439/578
7,513,722 B2 4/2009 Greenberg et al.
7,527,512 B2 5/2009 Montena
7,566,243 B1 7/2009 Hung
7,588,460 B2 9/2009 Malloy et al.
7,632,143 B1 * 12/2009 Islam ..... 439/583
7,635,283 B1 * 12/2009 Islam ..... 439/583
7,637,774 B1 * 12/2009 Vaccaro ..... 439/578
7,785,144 B1 * 8/2010 Islam ..... 439/583
7,798,847 B2 * 9/2010 Islam ..... 439/578
7,798,848 B2 * 9/2010 Islam ..... 439/578
7,806,724 B2 10/2010 Paynter et al.
7,811,133 B2 * 10/2010 Gray ..... 439/607.41
7,824,215 B2 * 11/2010 Islam et al. ..... 439/578
7,828,593 B2 * 11/2010 Gilliam ..... 439/578
7,857,661 B1 * 12/2010 Islam ..... 439/584
7,918,687 B2 4/2011 Paynter et al.
7,927,134 B2 4/2011 Paynter et al.
7,927,135 B1 * 4/2011 Wlos ..... 439/584
7,931,499 B2 * 4/2011 Islam ..... 439/584
7,993,159 B2 8/2011 Chawgo
8,007,314 B2 8/2011 Chawgo et al.
8,038,472 B2 10/2011 Montena et al.
8,047,870 B2 11/2011 Clausen
8,123,557 B2 2/2012 Montena et al.
8,136,234 B2 * 3/2012 Islam ..... 29/747
8,157,594 B2 * 4/2012 Gilliam ..... 439/607.41
8,177,583 B2 5/2012 Chawgo et al.
8,206,176 B2 * 6/2012 Islam ..... 439/578
8,419,468 B2 * 4/2013 Alrutz et al. ..... 439/578
8,439,703 B2 * 5/2013 Natoli ..... 439/578
8,449,325 B2 * 5/2013 Wild et al. ..... 439/578
8,460,031 B2 * 6/2013 Paynter et al. ..... 439/584
8,491,334 B2 * 7/2013 Rodrigues ..... 439/584
8,591,253 B1 * 11/2013 Chawgo et al. ..... 439/578
8,602,818 B1 * 12/2013 Chawgo et al. ..... 439/578
8,628,352 B2 * 1/2014 Nugent ..... 439/578
8,678,858 B2 * 3/2014 Islam ..... 439/578
8,708,737 B2 * 4/2014 Chawgo et al. ..... 439/578
2005/0079761 A1 4/2005 Rodrigues
2005/0118865 A1 * 6/2005 Henningsen ..... 439/578
2005/0159043 A1 * 7/2005 Harwath et al. ..... 439/578
2005/0159044 A1 * 7/2005 Harwath et al. ..... 439/578
2006/0014427 A1 1/2006 Islam et al.
2006/0040552 A1 * 2/2006 Henningsen ..... 439/578
2006/0134979 A1 * 6/2006 Henningsen ..... 439/583
2006/0199431 A1 9/2006 Paynter
2006/0246774 A1 11/2006 Buck
2007/0149047 A1 * 6/2007 Wild et al. ..... 439/578
2007/0270032 A1 11/2007 Eriksen
2008/0003873 A1 * 1/2008 Henningsen ..... 439/578
2008/0254678 A1 10/2008 Amidon
2008/0274643 A1 11/2008 Chawgo
2009/0197465 A1 8/2009 Montena et al.
2009/0233482 A1 9/2009 Chawgo et al.
2009/0269979 A1 10/2009 Montena
2010/0261381 A1 10/2010 Montena et al.
2010/0261382 A1 10/2010 Montena et al.
2010/0273340 A1 10/2010 Clausen
2011/0008998 A1 1/2011 Low et al.

(56) References Cited

U.S. PATENT DOCUMENTS

| | | | | |
|---|---|---|---|---|
| 2011/0009000 | A1 | 1/2011 | Paynter | |
| 2011/0021074 | A1* | 1/2011 | Paynter et al. | 439/584 |
| 2011/0230093 | A1* | 9/2011 | Paynter et al. | 439/578 |
| 2011/0263154 | A1 | 10/2011 | Chawgo et al. | |
| 2012/0088381 | A1 | 4/2012 | Wild et al. | |
| 2012/0088404 | A1 | 4/2012 | Wild et al. | |
| 2012/0088405 | A1* | 4/2012 | Wild et al. | 439/585 |
| 2012/0088406 | A1* | 4/2012 | Montena et al. | 439/585 |
| 2012/0088407 | A1 | 4/2012 | Natoli | |
| 2012/0102733 | A1 | 5/2012 | Wild | |
| 2012/0214338 | A1 | 8/2012 | Nugent | |
| 2013/0203287 | A1* | 8/2013 | Natoli | 439/578 |

FOREIGN PATENT DOCUMENTS

| | | | |
|---|---|---|---|
| EP | 2190068 | A1 | 5/2010 |
| EP | 2219267 | B1 | 8/2010 |
| KR | 200351496 | Y1 | 5/2004 |
| WO | 2005004290 | A1 | 1/2005 |

* cited by examiner

PORT ASSEMBLY CONNECTOR FOR ENGAGING A COAXIAL CABLE AND AN OUTER CONDUCTOR

CROSS REFERENCE TO RELATED APPLICATION

This application claims priority to U.S. Provisional Application No. 61/595,614 filed Feb. 6, 2012, which is incorporated herein in its entirety.

FIELD OF TECHNOLOGY

The following relates to port assembly connectors used in coaxial cable communications, and more specifically to embodiments of a port assembly connector having improved performance.

BACKGROUND

Connectors for coaxial cables are typically connected to complementary interface ports to electrically integrate coaxial cables to various electronic devices, including ports on cell towers. Often times, radial compression is used to crush the components within a connector into position, which may affect the dielectric layer of the cable, and adversely affect the electrical performance of the connector. Moreover, loose outer conductors can cause intermittent contact between conductive components, resulting undesirable Passive Intermodulation results, and a weakened RF shield.

Thus, a need exists for an apparatus and method for a port assembly that provides efficient engagement of the coaxial cable and the outer conductor without the above-indentified adverse effects.

SUMMARY

A first aspect relates generally to a port assembly comprising: an outer housing having a first end and a second end, wherein the outer housing is configured to receive a coaxial cable through the second end, wherein the outer housing is configured to mate with a coupling member of a corresponding coaxial cable connector, a clamp disposed within the outer housing, the clamp including a first compression surface, a second compression surface, wherein the second compression surface opposingly corresponds to the first compression surface, and wherein the first compression surface and the second compression surface cooperate via axial compression to secure an outer conductor of the coaxial cable.

A second aspect relates generally to a bulkhead connector for an equipment port comprising: an outer housing having a first end and a second end, wherein the outer housing is configured to receive a coaxial cable through the second end, wherein the outer housing is configured to mate with a coupling member of a corresponding coaxial cable connector, a clamp having a first end and a second end, the clamp having a first compression surface defined by a gradually decreasing inner diameter from the first end toward the second end, wherein the clamp engages the coaxial cable in an open position of the bulkhead connector, and a second compression surface disposed within the outer housing, the second compression surface having a conical shaped protrusion configured to opposingly correspond with the first compression surface, wherein the second compression surface does not secure a flared out portion of an outer conductor of the coaxial cable in the open position, wherein the second compression surface is axially slidably advanced into contact with the flared out portion of the outer conductor of the coaxial cable to achieve a closed position of the bulkhead connector.

A third aspect relates to a method of securing an outer conductor for use with a bulkhead connector comprising: disposing a clamp onto a prepared end of a coaxial cable, the clamp having a inwardly ramped portion, flaring out a portion of an outer conductor of the coaxial cable at an angle that resembles the inwardly ramped portion of the clamp, and advancing an outer housing disposed over the coaxial cable to bring the second compression surface toward the first compression surface to secure the outer conductor between the first compression surface of the clamp and the second compression surface, wherein the outer housing is configured to mate with a coupling member of a corresponding coaxial cable connector at a first end, and is configured to receive a coaxial cable through a second end.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
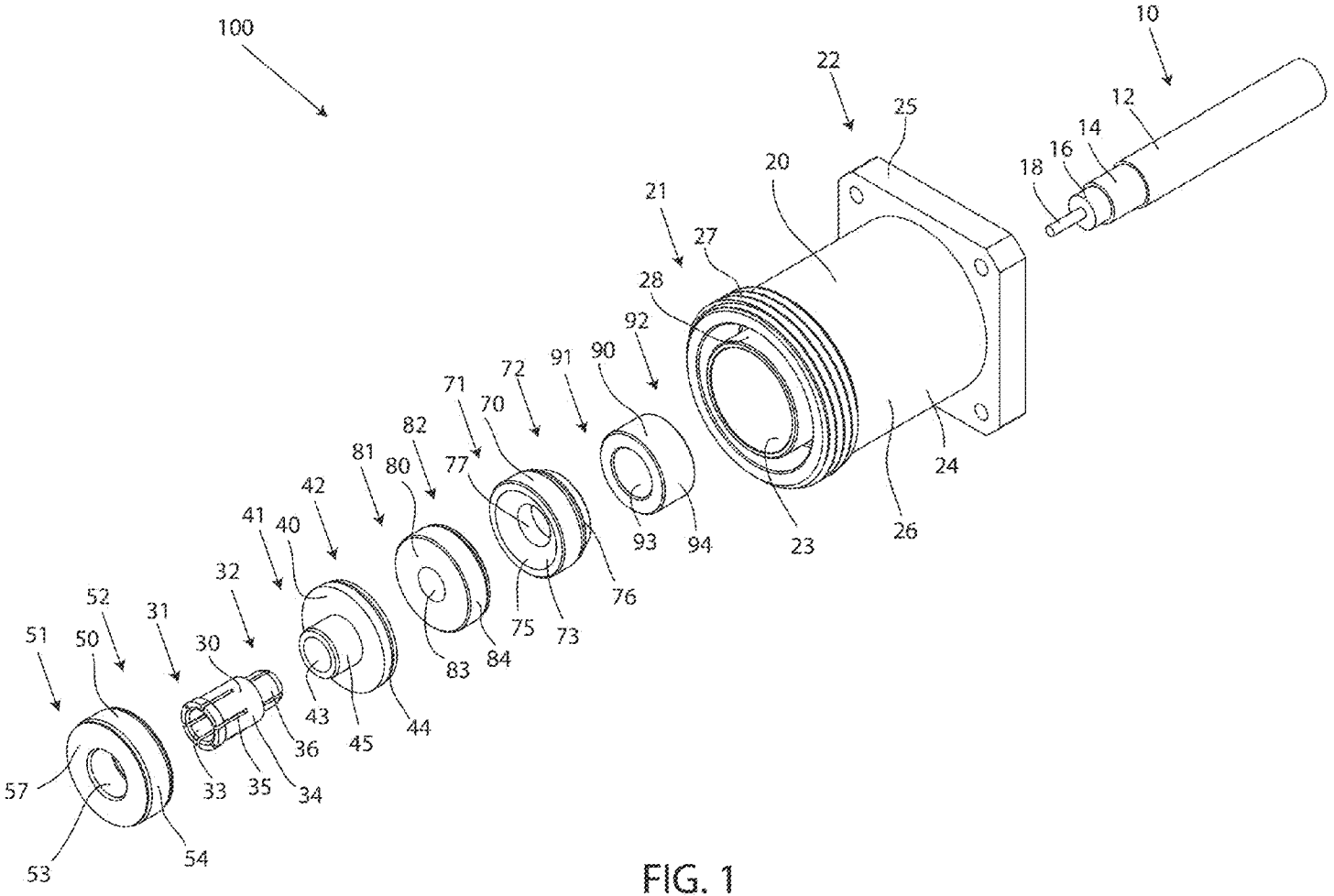
FIG. 1 depicts an exploded assembly view of a first embodiment of a port assembly connector.

Referring to the drawings, FIG. 1 depicts an embodiment of a port assembly connector 100, or port, may terminate a coaxial cable connector, such as a 50 Ohm cable connector, and may be configured to extend electrical continuity through a standard 50 Ohm coaxial cable engaging or securing the outer conductor 14 of a coaxial cable 10. Terminating a coaxial cable connector may occur when the connector is mated, threadably or otherwise, with port 100. Embodiments of port 100 may be a bulkhead, a bulkhead connector, a female port for a coaxial cable, a two-sided port, such as found in a splice, an equipment port, such as found on a cell tower, or any conductive receptacle configured to mate with a coaxial cable connector and/or receive a center conductive strand of a coaxial cable 10. Embodiments of the port assembly 100 may include a first end 1 and a second end 2. Embodiments of the port assembly 100 may be configured to matably receive a coaxial cable connector, such as a male coaxial cable connector affixed to a coaxial cable. The outer surface (or a portion thereof) of the port assembly 100 (i.e. outer housing 20 or bulkhead) may be threaded to accommodate an inner threaded surface of a coupling member of a male connector. However, embodiments of the outer surface of the port assembly 100 may be smooth or otherwise non-threaded. Further still, it should be understood by those of ordinary skill in the art that the port assembly 100 may be embodied by a connective interface component of a communications modifying device such as a signal splitter, a cable line extender, a cable network module and/or the like.

Figure 2:
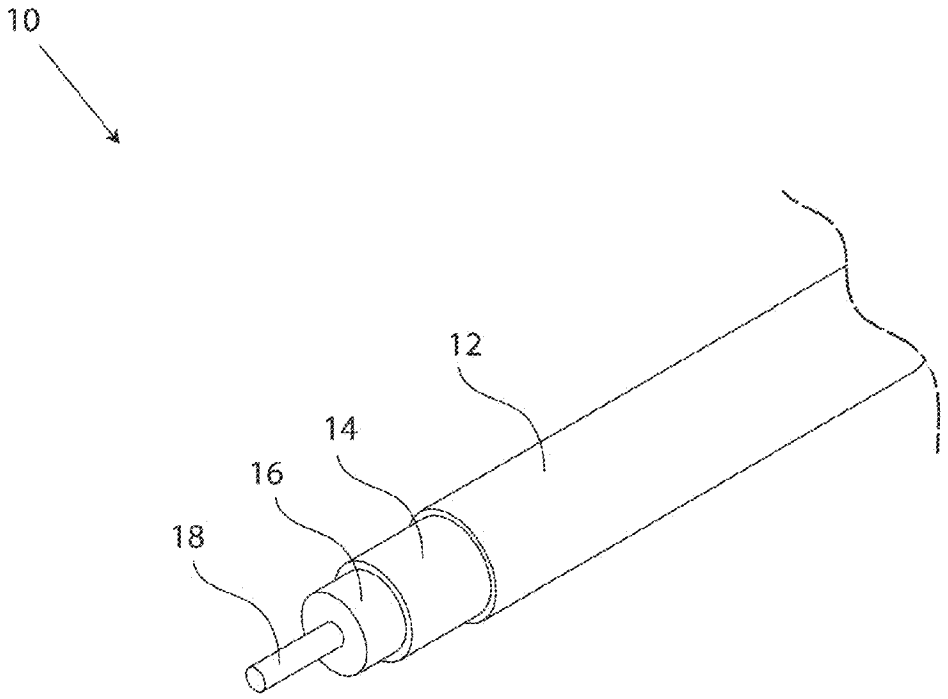
FIG. 2 depicts a perspective view of an embodiment of a coaxial cable.

Referring to FIG. 2, embodiments of a coaxial cable 10 may be securely attached to a coaxial cable connector. The coaxial cable 10 may include a center conductor 18, such as a strand of conductive metallic material, surrounded by an interior dielectric 16; the interior dielectric 16 may possibly be surrounded by an outer conductor 14; the outer conductor 14 is surrounded by a protective outer jacket 12, wherein the protective outer jacket 12 has dielectric properties and serves as an insulator. The outer conductor 14 may extend a grounding path providing an electromagnetic shield about the center conductor 18 of the coaxial cable 10. The outer conductor 14 may be a semi-rigid or rigid outer conductor of the coaxial cable 10 formed of conductive metallic material, and may be corrugated or otherwise grooved. For instance, the outer conductor 14 may be a tin soaked, tin plated copper wire braid, a smooth walled, annularly ribbed, spiral corrugated, or helical corrugated. The coaxial cable 10 may be prepared by removing a portion of the protective outer jacket 12 so that a length of the outer conductor 14 may be exposed, and then removing a portion of the outer conductor 14 to expose a portion of the dielectric 16; a length of the center conductor 18 may protrude from the dielectric 16. The protective outer jacket 12 can physically protect the various components of the coaxial cable 10 from damage that may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. The outer conductor 14 can be comprised of conductive materials suitable for carrying electromagnetic signals and/or providing an electrical ground connection or electrical path connection. Various embodiments of the outer conductor layer 14 may be employed to screen unwanted noise. The dielectric 16 may be comprised of materials suitable for electrical insulation. The protective outer jacket 12 may also be comprised of materials suitable for electrical insulation. Embodiments of the cable 10 may include a solid soldered braid outer conductor (e.g. essentially smoothwall) and a solid Teflon dielectric which may not be cored, or not very deep. It should be noted that the various materials of which all the various components of the coaxial cable 10 may have some degree of elasticity allowing the cable 10 to flex or bend in accordance with traditional broadband communications standards, installation methods and/or equipment. It should further be recognized that the radial thickness of the coaxial cable 10, protective outer jacket 12, outer conductor 14, interior dielectric 16, and/or center conductor 18 may vary based upon generally recognized parameters corresponding to broadband communication standards and/or equipment.

Figure 3:
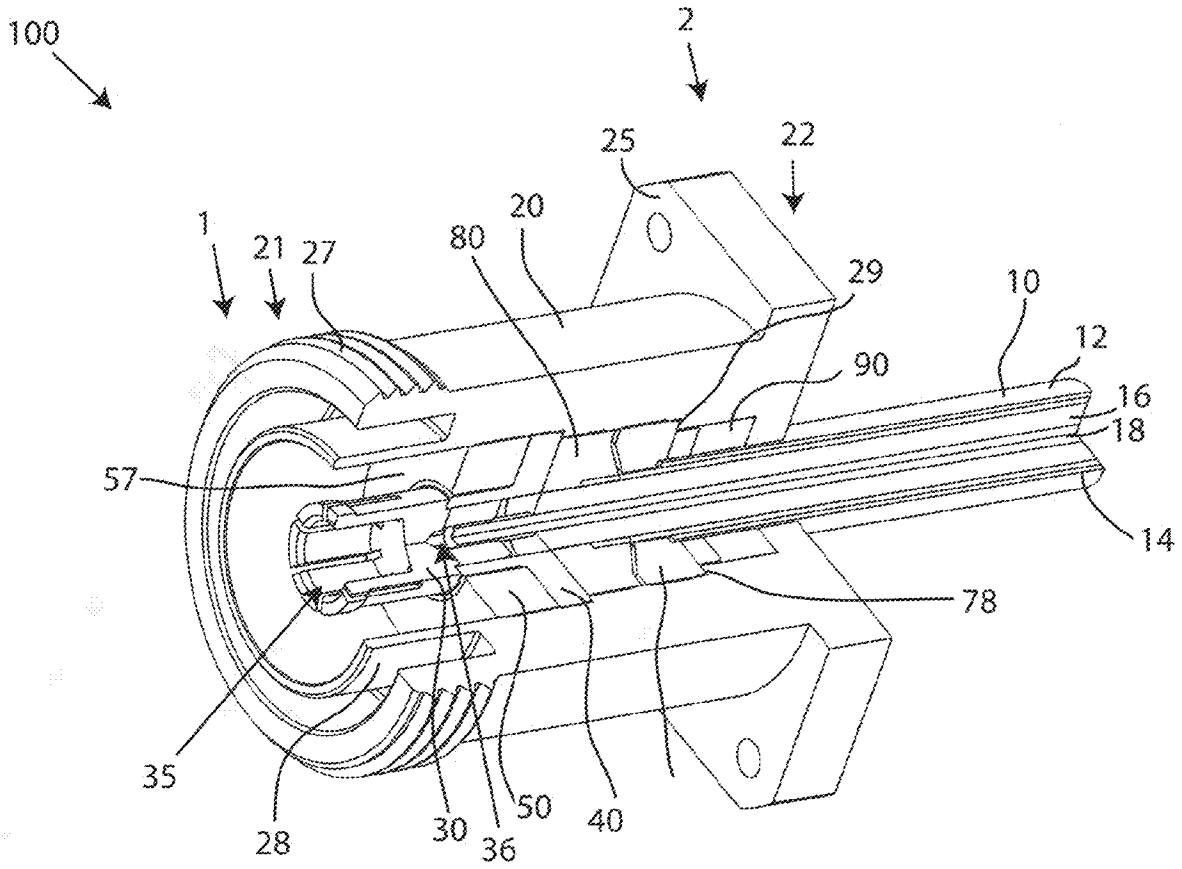
FIG. 3 depicts a partial cut-away, perspective view of the first embodiment of the port connector assembly.

Referring back to FIG. 1, and with additional reference to FIG. 3, embodiments of port assembly 100 may include an outer housing 20, an insulator body 50, a socket 30, an insert 40, a clamp 70, a compression component 80, and a collar 90.

Embodiments of the port 100 may include an outer housing 20. The outer housing 20 may be a bulkhead, a bulkhead connector outer housing, a bulkhead component, and the like. For instance, embodiments of the outer housing 20 may be configured to matably receive and/or terminate a coaxial cable connector. The outer housing 20 may include a first end 21 and a second end 22, an inner surface 23, and an outer surface 24, and may have a generally axial opening between the first end 21 and the second end 22 to accommodate one or more components within the outer housing 20. Embodiments of the outer housing 20 may also include a neck portion 26 extending from a mounting portion 25 proximate the second end 22 of the outer housing 20. Embodiments of the neck portion 25 and the mounting portion 26 may be structurally integral with each other forming a single, one-piece conductive component. The neck portion 26 of the outer housing 20 may be generally annular and include a threaded exterior portion 27 proximate or otherwise near the first end 21 of the outer housing 20. In other words, the outermost surface (or a portion thereof) of the port assembly 100, proximate the first end 1, may be threaded to accommodate an inner threaded surface of a coupling member of a connector. However, embodiments of the outer surface 24 of the outer housing 20, in particular, the neck portion 26, may be smooth or otherwise non-threaded. It should be recognized that the radial thickness and/or the length of the outer housing 20 and/or the conductive receptacle may vary based upon generally recognized parameters corresponding to broadband communication standards and/or equipment. Moreover, the pitch, depth, and length of threads of the threaded portion 27 which may be formed upon the outer surface 24 of the neck portion 26 of the outer housing 20 may also vary based upon generally recognized parameters corresponding to broadband communication standards and/or equipment, and the various types of coupling members of matable connectors. For instance, the outer housing 20, and the threaded portion 27 proximate the first end 21, may accommodate a wireless-N connector, DIN connector, and the like. Furthermore, it should be noted that the outer housing 20 may be formed of a single conductive material, multiple conductive materials, or may be configured with both conductive and non-conductive materials corresponding to the outer housing's electrical interface with a coaxial cable connector. Further still, it will be understood by those of ordinary skill that the outer housing may be embodied by a connective interface component of a communications modifying device such as a signal splitter, a cable line extender, a cable network module and/or the like.

Moreover, the outer housing 20 may include an inner collar portion 28 that may surround the socket 30 within the outer housing 20, proximate the first end 21 of the outer housing 20. Embodiments of the inner collar portion 28 may be generally annular member that can be structurally integral with the outer housing 20. While the inner collar portion 28 may be disposed radially around the socket 30, a radial distance between the socket 30 and inner collar portion 28 may be maintained to allow for the insulator body 50 disposed radially between the inner collar portion 28 and the socket 30, and potentially to conform to standards and specifications of various coupling members of coaxial cable connectors. Further, the structural configuration of the outer housing 20, including the dimensions and specifications, for example, the diameters of the inner collar portion 28, the diameter and length of the neck portion 26, and the thread patterns and size of the threaded portion 27, may be designed to meet industry standards and specifications to accommodate various cable connectors and coupling members. Moreover, the outer housing 20 may include an internal annular lip 29 proximate or otherwise near the second end 22 of the outer housing 20. The internal annular lip 29 may define a reduction in diameter of the generally axial opening within the outer housing 20. Embodiments of the internal annular lip 29 of the outer housing 20 may be configured to engage a mating edge 78 of the clamp 70 prevent or substantially hinder axial movement of the clamp 70 (and other port 100 components within the outer housing 20) subsequent to assembly and during and after axial compression. Additionally, embodiments of the outer housing may have inner diameter configured share a press-fit or interference fit with the components disposed within the outer housing, and the inner diameter of the outer housing 20 may change at one or more locations to facilitate secure retainment of one or more components within the outer housing 20. Manufacture of the outer housing 20 may casting, extruding, cutting, turning, drilling, compression molding, stamping, drawing, fabrication, punching, plating, or other fabrication methods that may provide efficient production of the metal, conductive component.

Figure 6:
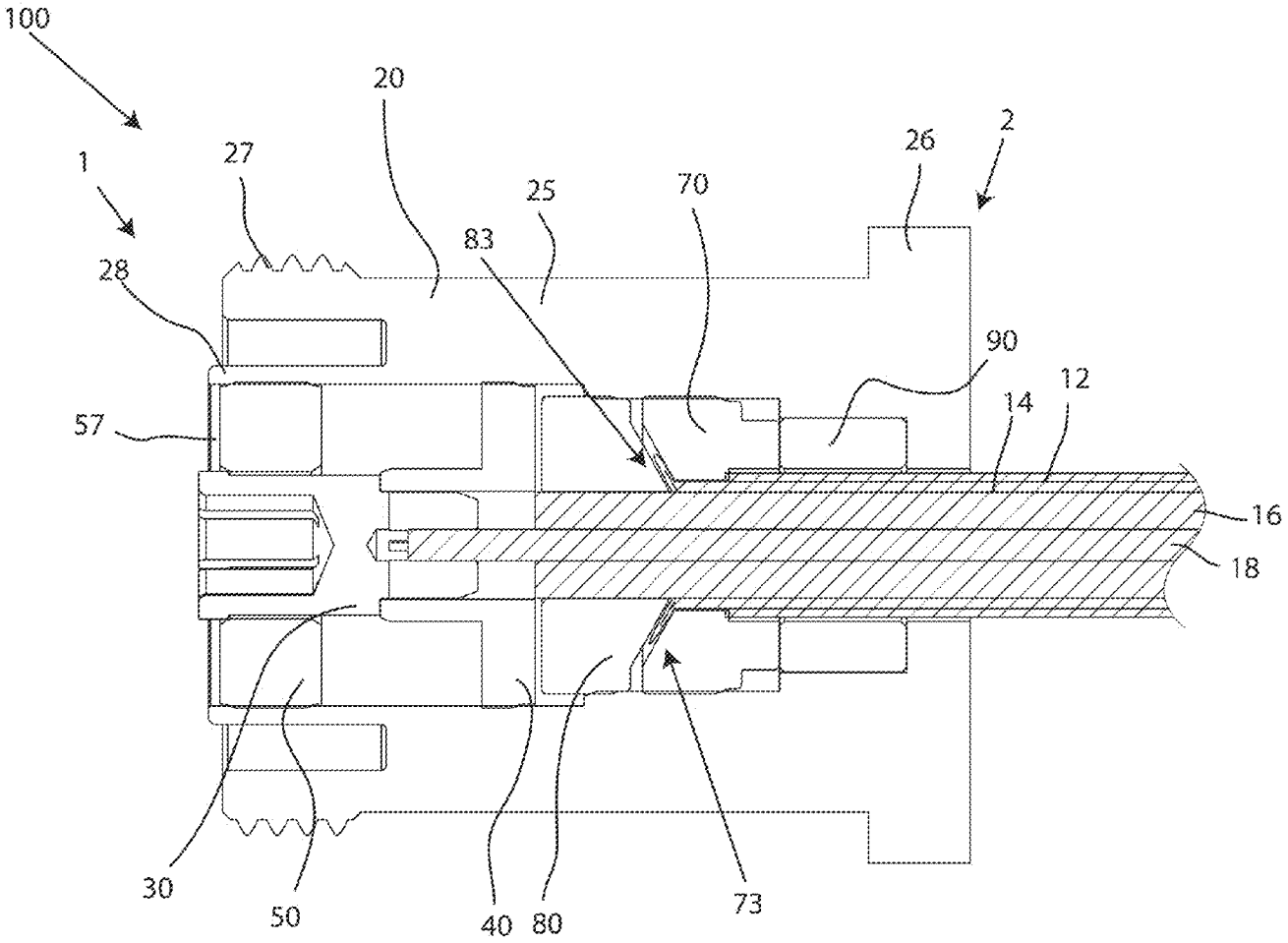
FIG. 6 depicts a cross-sectional view of the first embodiment of a port assembly connector in an open position.

Embodiments of the port assembly 100 may include an insulator body 50. The insulator body 50 may include a first end 51, a second end 52, an inner surface 53, and an outer surface 54. The insulator body 50 may be disposed within the outer housing 20, wherein the insulator body 50 surrounds or substantially surrounds at least a portion of insert 40. In particular, the insulator body 50, or seizure insulator, may surround the annular recessed portion 45 of the insert 40, while operably configured, and can seize the socket 30. When the insulator body 50 is inserted within the outer housing 20 during assembly, the insulator body 50 may bias the insert 40, or the annular recessed portion 45 into engagement with the socket 30 to facilitate securement of the socket 30. Moreover, the insulator body 50 may include an axially extending opening which may extend from the first end 51 through the second end 52. The opening may be a bore, hole, channel, tunnel, and the like. The insulator body 50, in particular, the opening of the insulator body 50 may accept, receive, accommodate, etc., the axially displaced electrical socket 40 and the annular recessed portion 45 of the insert 40 while operably configured. The insulator body 50 may be disposed within the outer housing 20. For instance, embodiments of the insulator body 50 may be sized and dimensioned to fit within the first end 21 of the outer housing 20, and in most embodiments, to fit within the diameter of the inner collar portion 28 of the outer housing 20; the outer surface 54 of the insulator body 50 may contact the inner surface 23 of the outer housing 20 proximate the inner collar portion 28, while operably configured (e.g. in a assembled configuration or a closed position). Moreover, in an open position, the insulator body 50 may located proximate or otherwise near the first end 21 of the outer housing, as shown in FIG. 6. Embodiments of the insulator body 50 may include an engagement surface 57. The engagement surface 57 may be a surface of the insulator body 50 that faces the first end 1 of the port assembly 100, and is configured to engage a component(s) of a tool for placement further within the outer housing and into a press-fit relationship with the outer housing 20 and the insert 40, which can exert a radial force against the insert 40 to help retain the socket 30. In a closed position, the insulator body 50 is press-fit within the outer housing, and may create a seal, such as an environmental seal. Embodiments of the insulator body 50 should be made of non-conductive, insulator materials, such as plastic, rubber, and the like. Manufacture of the insulator body 50 may include casting, extruding, cutting, turning, drilling, compression molding, injection molding, spraying, or other fabrication methods that may provide efficient production of the component. Other embodiments of the insulator body 50 may an insulator having a Z-shaped cross-section, or a hard plastic body having a plurality of milled pockets.

With continued reference to FIGS. 1 and 3, embodiments of the port assembly 100 may include a socket 30. The socket 30 may have a first end 31, a second end 32, an inner surface 33, and an outer surface 34. Embodiments of the socket 30 may be a conductive element that may extend or carry an electrical current and/or signal from a first point to a second point. Embodiments of the socket 30 may be a female receptacle or socket configured to receive a center conductive strand, such as a conductive pin, of a male connector, at the first end 31, and a center conductor 18 of a coaxial cable 10 at the second end 32. The socket 30 may be a conductive center conductor clamp or basket that clamps, grips, collects, receives, or mechanically compresses onto the male conductive pin or center conductive strand 18 of a coaxial cable 10. The socket 30 may further include a first opening 35, wherein the first opening 35 may be an opening, bore, hole, channel, and the like for accepting a center conductive pin or terminal from a matable male connector, and a second opening 35, wherein the second opening 36 may be an opening, bore, hole, channel, and the like, for accepting a center conductive strand 18 of a coaxial cable 10. Additionally, embodiments of the socket 30 may be slotted or otherwise resilient to permit deflection of the socket 30 as conductive strands are received. Embodiments of the socket 30 may be sized and dimensioned to fit within the outer housing 20 proximate or otherwise near the first end 21 of the outer housing 20, and may have an outer diameter sized and dimensioned to fit within the axial opening of the insert 40. Embodiments of the socket 30 should be formed of conductive materials.

Embodiments of the port assembly 100 may also include an insert 40. The insert 40 may include a first end 41 and a second 42, an inner surface 43, and an outer surface 44. Embodiments of the insert 40 may be a generally annular member, having a generally axial opening therethrough. However, proximate the first end 41 of the insert 40, an annular recessed portion 45 of the insert 40 may surround the second end 32 of the socket 30. Embodiments of the annular recessed portion 45 may facilitate firm physical contact between the socket 30 and the received center conductor 18 of the coaxial cable 10. In addition, the insert 40 may electrically isolate the socket 30 from the outer housing 20, during the assembled and compressed positions. Embodiments of the insert 40 may be configured to move within the outer housing 20 upon axial compression; the movement of the insert 40 may be synchronous with the socket 30 as the insulator body 50 is displaced into contact with the insert 40. Embodiments of the insert 40 should be made of non-conductive, insulator materials. Manufacture of the insert 40 may include casting, extruding, cutting, turning, drilling, compression molding, injection molding, spraying, or other fabrication methods that may provide efficient production of the component.

Figure 4A:
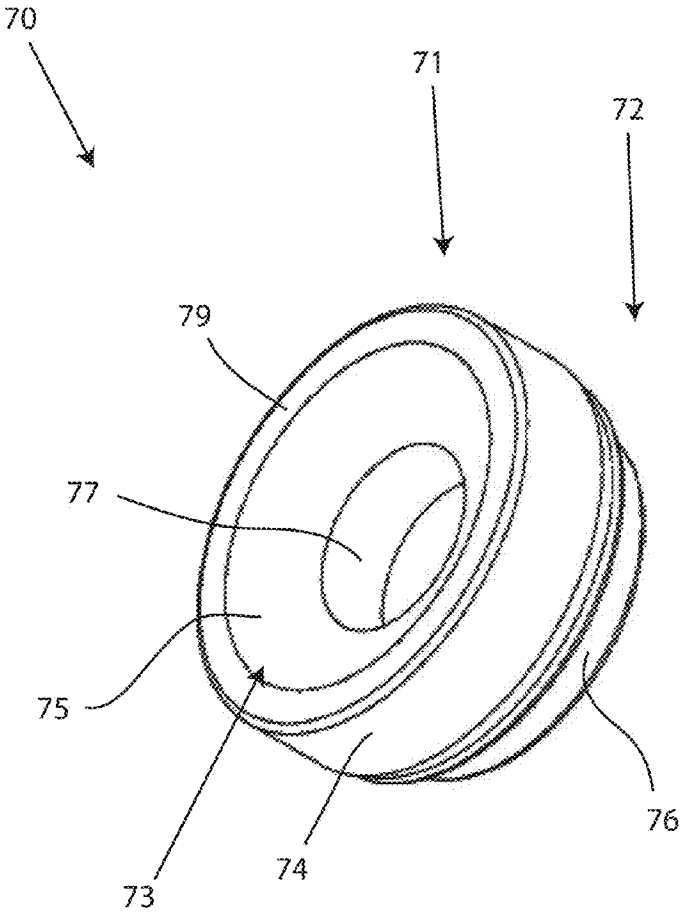
FIG. 4A depicts a perspective view of an embodiment of a clamp.
Figure 4B:
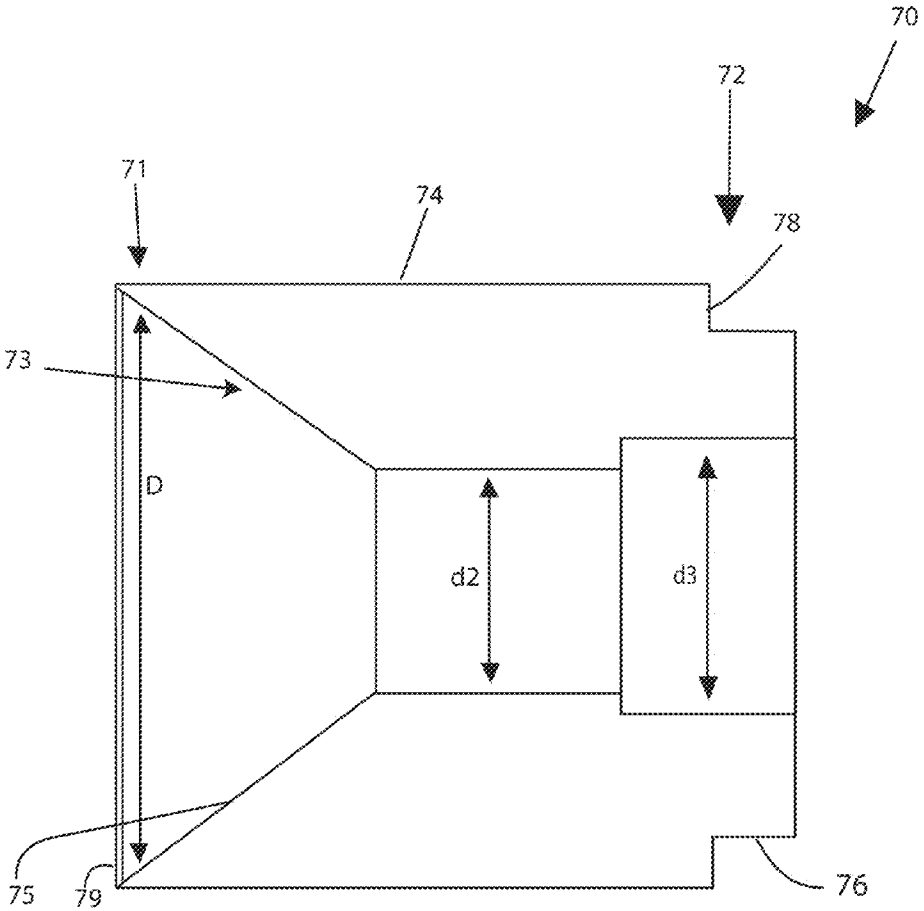
FIG. 4B depicts a cross-section view of an embodiment of a clamp.

Referring still to FIGS. 1 and 3, and with additional reference to FIGS. 4A and 4B, embodiments of the port assembly 100 may include a clamp 70. Embodiments of the clamp 70 may be a clamp, a seizing element, a moveable clamp, a first compression component, a first conical member, an outer conductor-cable jacket engagement member, a cable engagement member, a clamp driver, a driver component, or any generally annular member configured to compress and/or clamp a coaxial cable 10 and/or an outer conductor 14. Embodiments of the clamp 70 may be a solid, generally annular member having a first end 71 and a second end 72, a generally axial opening therethrough, and an inwardly conically projecting opening proximate or otherwise near the first end 71. Embodiments of a clamp 70 may be a solid clamp having a continuous, uninterrupted revolution across the axial distance of the clamp. However, some embodiments of the clamp 70 may be slotted to provide resiliency. Embodiments of the clamp 70 may be disposed within the outer housing 20, and may be moveable within the outer housing 20 upon axial compression. For example, the clamp 70 may be press-fit to its final location or a pre-axial compression location within the outer housing 20 prior to axial compression, as shown in FIG. 6. Furthermore, embodiments of the clamp 70 may include an annular mating edge 78 configured to engage an internal annular lip 29 of the outer housing to counteract the axial compression force (e.g. act as a stop) after proper and/or sufficient axial displacement of the clamp 70 has occurred within the outer housing 20. Embodiments of mating edge 78 of the clamp 70 may define an annular recessed edge 76 proximate or otherwise near the second end 72.

Embodiments of the clamp 70 may include a first compression surface 73. The first compression surface 73 may be configured to sandwich, pinch, clasp, clamp, secure, retain, etc., the outer conductor 14 of a coaxial cable 10 via cooperation with an opposing, second compression surface 83. The first compression surface 73 may defined by an annular ramped surface 75 that can inwardly project from the first end 71 towards the second end 72. Embodiments of the annular ramped surface 75 may define a gradually decreasing internal diameter from a first diameter, $d_1$, proximate or otherwise near the first end 71 to a second, constant or substantially constant diameter, $d_2$, between the first end 71 and the second end 72. In other words, the clamp 70 may include an internal opening or passageway defined by a first diameter, $d_1$, that may be tapered, or otherwise conical, an axial distance from the first end 71 to a second, constant, or substantially constant, diameter, $d_2$. Embodiments of the second, constant diameter, $d_2$, may be such that the outer conductor 14 may be engaged at a point where the outer conductor 14 can ride up the annular ramped surface 75 and flare out when the port 100 is axially compressed into a compressed position. However, embodiments of clamp 70 may include a third diameter, $d_3$, which is defined by an increase in the internal diameter of the clamp 70 proximate or otherwise near the second end 72 to potentially provide clearance for a portion of the cable jacket 12 as the cable 10 enters the opening of the clamp 70. Moreover, embodiments of the clamp 70 may include a chamfer 79 proximate or otherwise near the first end 71, wherein the chamfer 79 may have a different inclination angle or ramp angle than the annularly ramped surface 75. In some embodiments, the chamfer 79 may be considered part of the first compression surface 73, and may also have an opposing chamfer, such as chamfer 89, located on the compression component 80. Furthermore, the clamp 70 may be made of conformal materials, and may be non-conductive. For example, the clamp 70 may be made of plastics, composites, or other insulating material that may form a conformal body. Alternatively, embodiments of the clamp 70 may be conductive, and may be made of metallic materials. Manufacture of the clamp 70 may include casting, extruding, cutting, turning, drilling, compression molding, injection molding, spraying, or other fabrication methods that may provide efficient production of the component.

Figure 5:
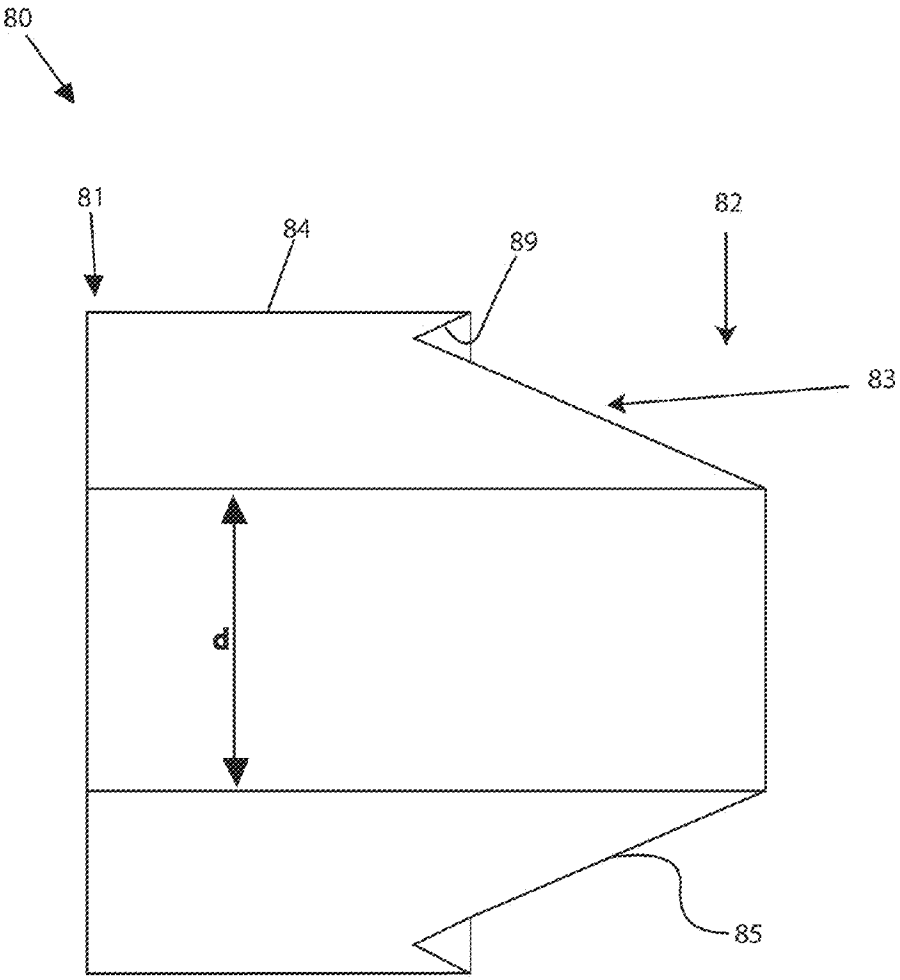
FIG. 5 depicts a cross-sectional view of an embodiment of a compression component.
Figure 7:
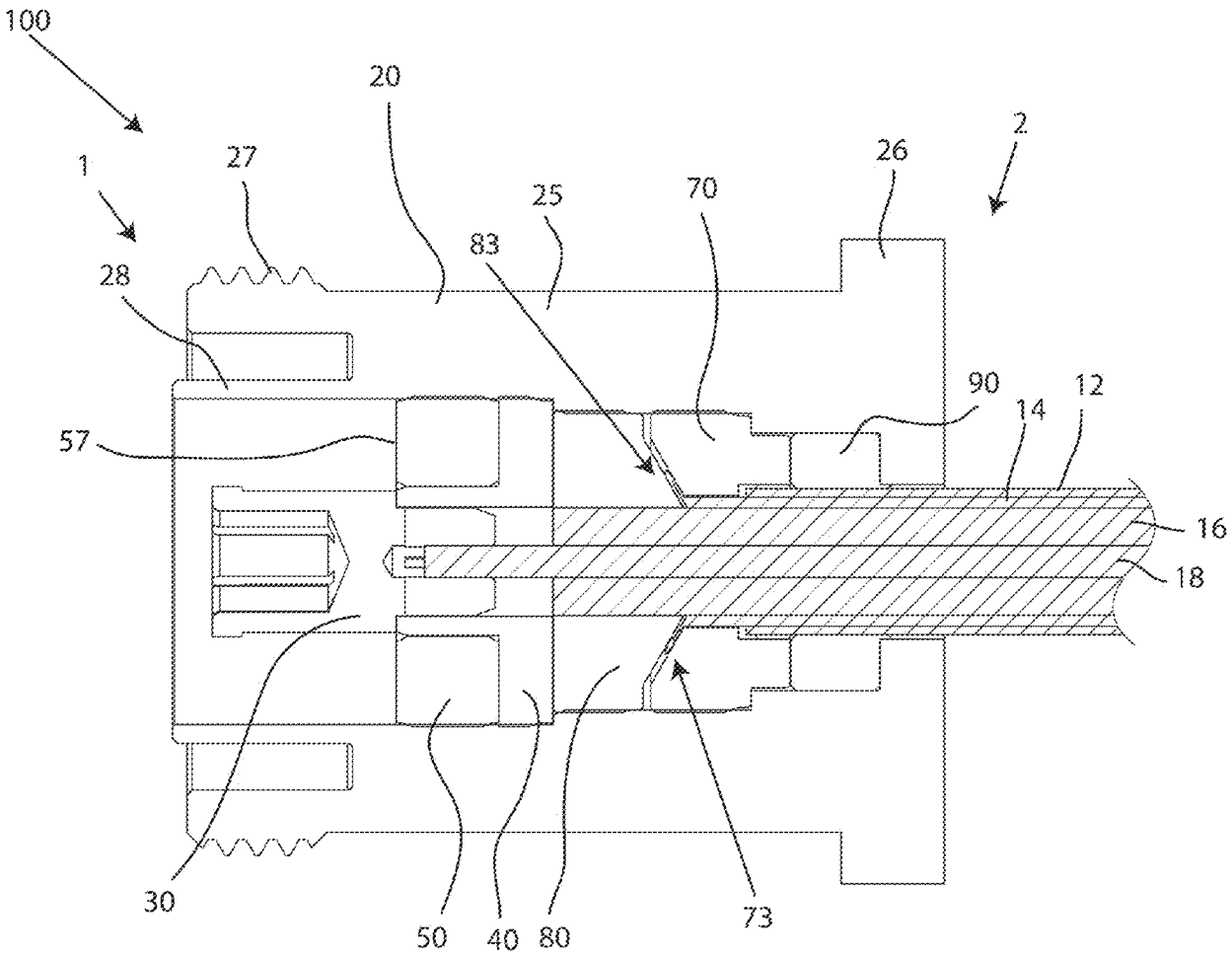
FIG. 7 depicts a cross-sectional view of the first embodiment of the port assembly connector in a closed position.

Referring again to FIGS. 1 and 3, and now with additional reference to FIG. 5, embodiments of port assembly 100 may include a compression component 80. The compression component 80 may be a second conical member, an outer conductor engagement member, an outer conductor compression member, a second compression component, a contact cone, a contact member, a contact component, and the like. Embodiments of the compression component 80 may be a solid, generally annular member having a protruding conical section. For example, embodiments of the compression component 80 may be a generally annular member proximate or otherwise near a first end 71 and a protruding conical section proximate or otherwise near a second end 72, and a generally axial opening therethrough, wherein the general axial opening may have a constant or substantially constant diameter, d. Embodiments of the diameter, d, of the compression component 80 may be slightly smaller than the second diameter, $d_2$, of the clamp 70 to operably engage and flare out the outer conductor 14 of the cable 10, as shown in FIGS. 6 and 7. In one embodiment, the diameter, d, of the compression component may be equal or approximately than same size as the diameter of the dielectric 16 of the cable 10. Embodiments of a compression component 80 may be a solid member having a continuous, uninterrupted revolution across the axial distance of the compression component 80. However, some embodiments of the compression component 80 may be slotted to provide resiliency. Embodiments of the compression component 80 may be disposed within the outer housing 20, and may be moveable within the outer housing 20 upon axial compression. For example, the compression component 80 may be press-fit to a pre-axial compression location within the outer housing 20 prior to axial compression.

Furthermore, embodiments of the compression component 80 may include a second compression surface 83, wherein the second compression surface opposingly corresponds to the first compression surface 73. The second compression surface 83 may be an opposing annularly ramped surface 85 of the protruding conical section of the compression component 80, and may be configured to sandwich, pinch, clasp, clamp, secure, retain, etc., the outer conductor 14 of a coaxial cable 10 via cooperation with the first compression surface 73. The second compression surface 83 may defined by an annular ramped surface 85 that can protrude from the second end 72. Embodiments of the annular ramped surface 85 may define a gradually decreasing outer diameter, while an internal diameter, d, remains constant or substantially constant. In other words, the compression component 80 may include an annular ramped, or conical, outwardly projecting portion configured to cooperate with the inwardly projected opening of the clamp 70. Embodiments of the first compression surface 73 and the second compression surface 83 may be opposing annular ramped, or conical, surfaces that may cooperate to clamp, secure, or otherwise retain the outer conductor 14 of the cable 10. Moreover, embodiments of the compression component 80 may further include a chamfer 89 proximate or otherwise near the second end 82, wherein the chamfer 89 may have a different inclination angle or ramp angle than the annularly ramped surface 85. In some embodiments, the chamfer 89 may be considered part of the second compression surface 83, and may also have an opposing chamfer, such as chamfer 79, located on the clamp 70. Furthermore, the compression component 80 may be made of rigid, metal materials, and may be conductive. For example, the compression component 80 may be made of metal or a combination of metals, such as metals including copper, brass, nickel, aluminum, steel, and the like, to facilitate the clamping and flaring out of the outer conductor 14 and/or facilitating a continuous RF shield through the port assembly 100. Alternatively, embodiments of the compression component 80 may be made of conformal materials, and may be non-conductive. For example, the compression component 80 may be made of plastics, composites, or other insulating material that may form a conformal body. Manufacture of the compression component 80 may include casting, extruding, cutting, turning, drilling, compression molding, stamping, drawing, fabrication, punching, plating, or other fabrication methods that may provide efficient production of the metal, conductive component.

Referring back to FIGS. 1 and 3, embodiments of the port assembly 100 may include a collar 90. The collar 90 may include a first end 91, a second end 92, an inner surface 93, and an outer surface 94. The collar 90 may be a generally annular tubular member. The collar 90 may be a solid sleeve collar and may be disposed within the outer housing 20 proximate or otherwise near the clamp 70. For instance, collar 90 may be disposed around the cable jacket 12 of the coaxial cable 10 when the cable 10 enters the outer housing 20 from the second end 22. When the port assembly 100, in particular, the components within the outer housing 20 are axially compressed, the collar 90 may undergo some deformation which may form a seal around the cable 10. For instance, the collar 90 may deform and sealingly engage the cable jacket 12 to prevent the ingress of environmental elements, such as rainwater and moisture through the opening on the mounting portion 26 from which the cable 10 enters the outer housing 20. Additionally, the collar 90 should be made of non-conductive, insulator materials, and can be made of elastomeric materials, rubber, and the like. Manufacture of the collar 90 may include casting, extruding, cutting, turning, drilling, compression molding, injection molding, spraying, or other fabrication methods that may provide efficient production of the component.

Referring now to FIGS. 6 and 7, the manner in which port assembly 100 may be assembled, then moved from a first, open position to a second, closed position to secure the outer conductor 14 of cable 10 is now described. FIG. 6 depicts an embodiment of the port assembly 100 in an open position. The open position may refer to a position or arrangement wherein the port assembly 100 may not be fully assembled, and press-fit engagement of one or more components may still be required. Alternatively, the open position may refer to an assembled position, wherein a flared out portion of the outer conductor is not fully secured between the first compression surface 73 and the second compression surface 83. The assembly of the port assembly connector 100 may first involve preparing an end of the cable 10, as described above, and placing the outer housing over the cable 10 such that the cable 10 extends through the generally axial opening of the outer housing 20. Then, an installer may place the collar 90 and the clamp 70 onto the cable 10. An installer can now prep the outer conductor 14 by flaring it out with the use of a tool, and may press the outer conductor 14 against the annular inwardly projecting surface of the clamp 70. Those skilled in the art should appreciate that a tool used to flare out the outer conductor 14 could encompass various styles and types of tools, and the prep of the outer conductor 14 could potentially done without the help of a tool. After the outer conductor 14 is prepped and flared out, the installer may place the compression component 80 over the cable 10 and arrange the outwardly ramped section of the compression component 80 to secure the outer conductor 14 between the opposingly conical compression surfaces 73, 83. Next, the installer may place the insert 40 onto the cable 10 and then the socket 30 may be mated with the center conductor 18 of the cable generally around the recessed portion 45 of the insert 40, or bushing type insert 40. Lastly, the installer may insert the insulator body 50 within the collar portion 28 of the outer housing 20. To achieve the closed position, as shown in FIG. 7, the installer may compress, or otherwise displace the insulator body 50 further within the outer housing 20 until the insulator body 50 is press-fit within the outer housing 20. Because the other components, such as the compression component 80, the clamp 70, and insert 40 may each have outer annularly ramped surface that define an increase in an outer diameter, when the insulator body 50 is driven within the outer housing 20 and displacing the other components, the larger outer diameters of the other components can become press-fit within the outer housing 20, and securely retain the components with the post assembly connector 100.

Figure 8:
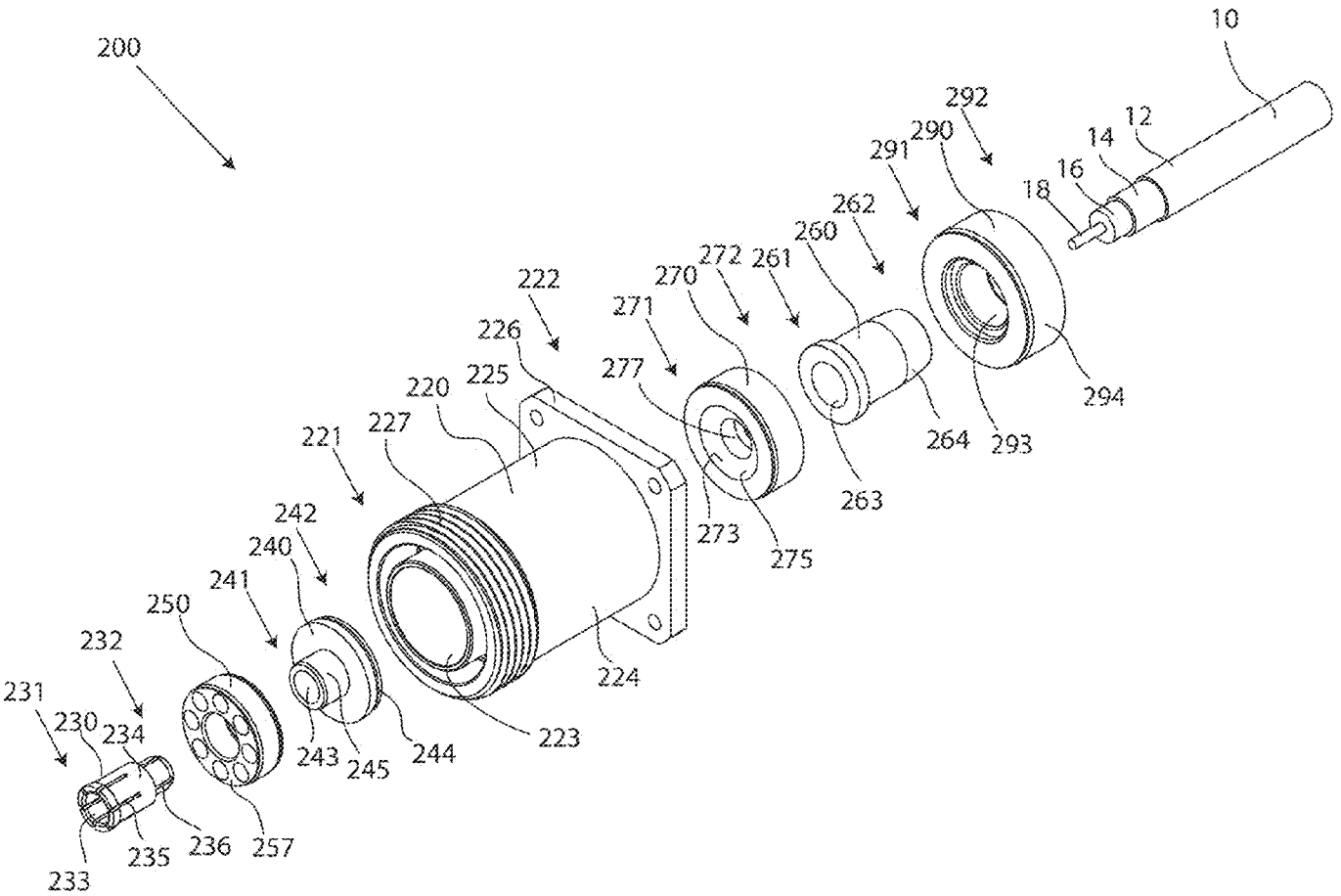
FIG. 8 depicts an exploded assembly view of a second embodiment of a port assembly connector.

Referring still to the drawings, FIG. 8 depicts an embodiment of a port assembly 200, or port, may terminate a coaxial cable connector, and may be configured to extend electrical continuity through a coaxial cable clamping the outer conductor 14 of a coaxial cable 10. Terminating a coaxial cable connector may occur when the connector is mated, threadably or otherwise, with port 200. Embodiments of port 200 may be a bulkhead, a bulkhead connector, a female port for a coaxial cable, a two-sided port, such as found in a splice, an equipment port, such as found on a cell tower, or any conductive receptacle configured to mate with a coaxial cable connector and/or receive a center conductive strand of a coaxial cable 10. Embodiments of the port assembly 200 may include a first end 201 and a second end 202. Embodiments of the port assembly 200 may be configured to matably receive a coaxial cable connector, such as a male coaxial cable connector affixed to a coaxial cable. The outer surface (or a portion thereof) of the port assembly 200 (i.e. outer housing 220 or bulkhead) may be threaded to accommodate an inner threaded surface of a coupling member of a male connector. However, embodiments of the outer surface of the port assembly 200 may be smooth or otherwise non-threaded. Further still, it should be understood by those of ordinary skill in the art that the port assembly 200 may be embodied by a connective interface component of a communications modifying device such as a signal splitter, a cable line extender, a cable network module and/or the like.

Embodiments of part assembly connector 200 may include an outer housing 220 having an integral compression component 280, a clamp 270, an insulator body 250, a socket 230, an insert 240, a cable sealing element 260, and a collar 290.

Figure 9:
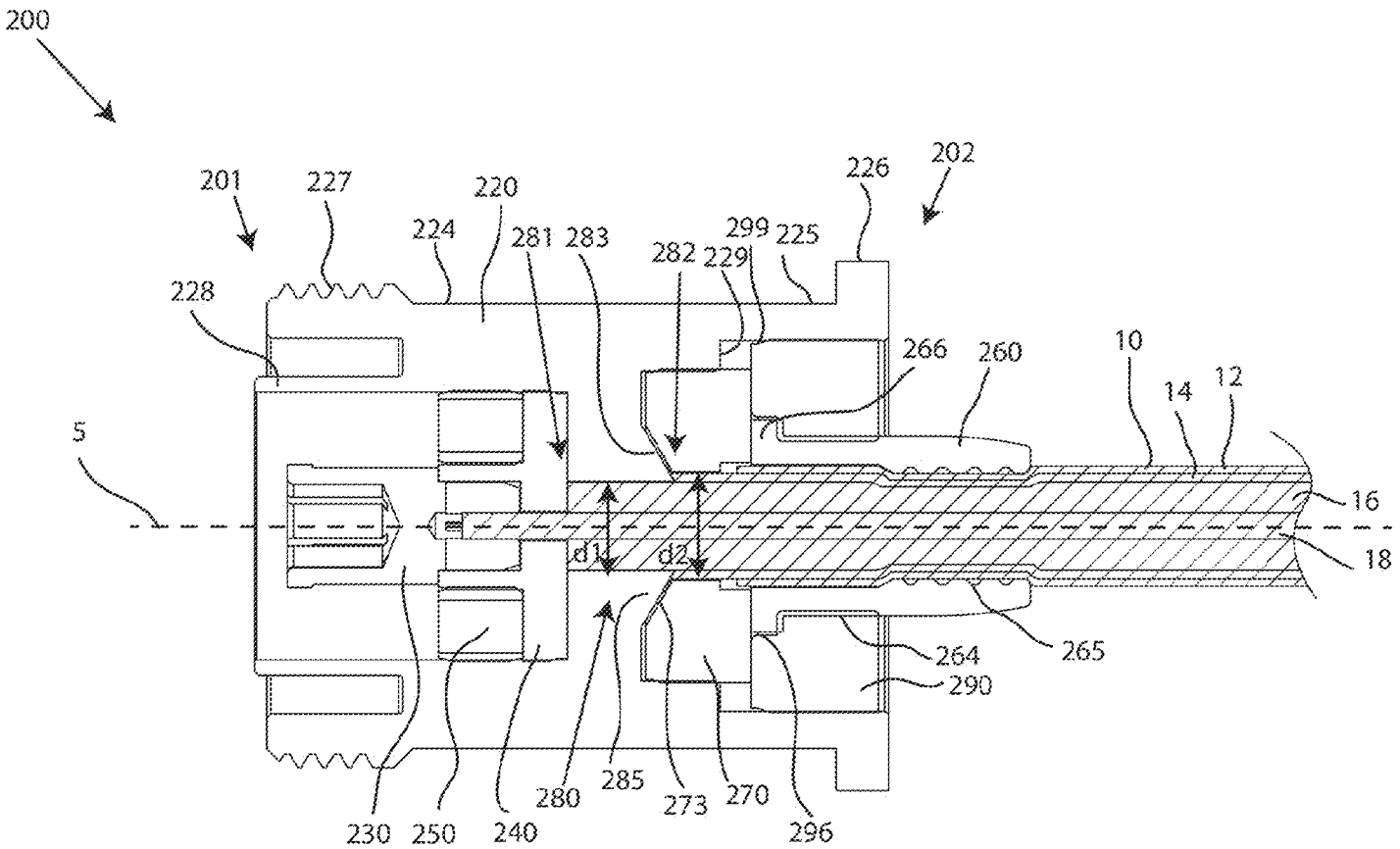
FIG. 9 depicts a cross-sectional view of the second embodiment of the port assembly connector with an integral compression component.

Referring still to FIG. 8, and with additional reference to FIG. 9, embodiments of the port assembly 200 may include an outer housing 220. Embodiments of outer housing 220 may share the same or substantially the same structural and functional aspects as outer housing 20 described in association with port assembly 100. For instance, the outer housing 220 may be a bulkhead, a bulkhead connector outer housing, a bulkhead component, and the like; embodiments of the outer housing 220 may be configured to matably receive and/or terminate a coaxial cable connector. The outer housing 220 may include a first end 221 and a second end 222, an inner surface 223, and an outer surface 224, and may have a generally axial opening between the first end 221 and the second end 222 to accommodate one or more components within the outer housing 220. Embodiments of the outer housing 220 may also include a neck portion 226 extending from a mounting portion 225 proximate the second end 222 of the outer housing 220. Embodiments of the neck portion 225 and the mounting portion 226 may be structurally integral with each other forming a single, one-piece conductive component. The neck portion 226 of the outer housing 220 may be generally annular and include a threaded exterior portion 227 proximate or otherwise near the first end 221 of the outer housing 220. In other words, the outermost surface (or a portion thereof) of the port assembly 200, proximate the first end 201, may be threaded to accommodate an inner threaded surface of a coupling member of a connector. However, embodiments of the outer surface 224 of the outer housing 220, in particular, the neck portion 226, may be smooth or otherwise non-threaded. It should be recognized that the radial thickness and/or the length of the outer housing 220 and/or the conductive receptacle may vary based upon generally recognized parameters corresponding to broadband communication standards and/or equipment. Moreover, the pitch, depth, and length of threads of the threaded portion 227 which may be formed upon the outer surface 224 of the neck portion 226 of the outer housing 220 may also vary based upon generally recognized parameters corresponding to broadband communication standards and/or equipment, and the various types of coupling members of matable connectors. For instance, the outer housing 220, and the threaded portion 227 proximate the first end 221, may accommodate a wireless-N connector, DIN connector, and the like. Furthermore, it should be noted that the outer housing 220 may be formed of a single conductive material, multiple conductive materials, or may be configured with both conductive and non-conductive materials corresponding to the outer housing's electrical interface with a coaxial cable connector. Further still, it will be understood by those of ordinary skill that the outer housing may be embodied by a connective interface component of a communications modifying device such as a signal splitter, a cable line extender, a cable network module and/or the like.

Moreover, the outer housing 220 may include an inner collar portion 228 that may surround the socket 230 within the outer housing 220, proximate the first end 221 of the outer housing 220. Embodiments of the inner collar portion 228 may be generally annular member that can be structurally integral with the outer housing 220. While the inner collar portion 228 may be disposed radially around the socket 230, a radial distance between the socket 230 and inner collar portion 228 may be maintained to allow for the insulator body 250 disposed radially between the inner collar portion 228 and the socket 230, and potentially to conform to standards and specifications of various coupling members of coaxial cable connectors. Further, the structural configuration of the outer housing 220, including the dimensions and specifications, for example, the diameters of the inner collar portion 228, the diameter and length of the neck portion 226, and the thread patterns and size of the threaded portion 227, may be designed to meet industry standards and specifications to accommodate various cable connectors and coupling members. Moreover, the outer housing 220 may include an internal annular lip 229 within the outer housing 220. The internal annular lip 229 may define an increase in diameter of the generally axial opening proximate the second end 222 of the outer housing 220. Embodiments of the internal annular lip 229 of the outer housing 220 may be configured to allow insertion of the collar 290 within the outer housing 220. Manufacture of the outer housing 20 may casting, extruding, cutting, turning, drilling, compression molding, stamping, drawing, fabrication, punching, plating, or other fabrication methods that may provide efficient production of the metal, conductive component.

Furthermore, the outer housing 220 may include an integral compression component 280. The integral compression component 280 may be structurally integral with the outer housing 220. Embodiments of the integral compression component 280 may radially inwardly extend into the general axial opening of the outer housing 220. Embodiments of the integral compression component 280 may include an opening proximate or at a central axis 5 to accommodate portions of the cable 10, for example, an exposed portion of the dielectric 16 and the center conductor 18. Moreover, embodiments of the integral compression component 280 of the outer housing 220 may include a conical section 285. Embodiments of the conical section 285 of the integral compression component 280 of the outer housing 220 may be an outwardly projecting portion defined by an annularly ramped surface. The integral compression component 280 may be a second conical member, an outer conductor engagement member, an outer conductor compression member, a second compression component, a contact cone, a contact member, a contact component, and the like. Embodiments of the integral compression component 280 may be a solid, generally annular portion of the outer housing 220 having a protruding conical section 285 proximate a second end 282 of the integral compression component 280. For example, embodiments of the integral compression portion 280 may include a protruding conical section 285 proximate or otherwise near a second end 282, and a generally axial opening therethrough, wherein the general axial opening may have a constant or substantially constant diameter, $d_1$. Embodiments of the diameter, $d_1$, of the integral compression component 280 may be slightly smaller than the second diameter, $d_2$, of the clamp 270 to operably engage the flared out the outer conductor 14 of the cable 10, as shown in FIG. 9. In one embodiment, the diameter, $d_1$, of the integral compression portion 280 may be equal or approximately the size as the diameter of the dielectric 16 of the cable 10.

Furthermore, embodiments of the integral compression component 280 may include a second compression surface 283, wherein the second compression surface 283 opposingly corresponds to a first compression surface 273. The second compression surface 283 may be an opposing annularly ramped surface of the protruding conical section 285 of the integral compression component 280, and may be configured to sandwich, pinch, clasp, clamp, secure, retain, etc., the outer conductor 14 of a coaxial cable 10 via cooperation with the first compression surface 273 during assembly of the port assembly 200. The second compression surface 283 may defined by an annular ramped surface that can protrude from the second end 282. Embodiments of the annular ramped surface may define a gradually decreasing outer diameter, while an internal diameter, $d_1$, remains constant or substantially constant. In other words, the integral compression component 280 may include an annular ramped, or conical, outwardly projecting portion configured to cooperate with the inwardly projected opening of the clamp 270. Embodiments of the first compression surface 273 and the second compression surface 283 may be opposing annular ramped, or conical, surfaces that may cooperate to clamp, secure, or otherwise retain the outer conductor 14 of the cable 10. Moreover, embodiments of the integral compression component 280 may be formed from the outer housing 220, which may include rigid, metal materials, and may be conductive. For example, the integral compression component 280 may be made of metal or a combination of metals, such as metals including copper, brass, nickel, aluminum, steel, and the like, to help secure the outer conductor 14 and facilitate a continuous RF shield through the port assembly 200. Because the outer housing 220 includes an integral compression portion 280, the second compression surface may be provided without introducing a separate component. Thus, the overall component count of the assembly of the port connector may be reduced. Additionally, the integral compression component 280 can afford protection to the edge, which may be sharp, of the second end 282 of the compression component 280. The integral compression component 280 may also simplify the assembly steps for an installer because he or she may verify that the outer conductor 14 is secured and the outer housing 220 is secured to the cable 10, prior to continuing and completing the installation of the other components, as described in greater detail below.

Referring still to FIGS. 8 and 9, embodiments of the port assembly 200 may include a clamp 270. Embodiments of the clamp 270 may be a clamp, a seizing element, a moveable clamp, a first compression component, a first conical member, an outer conductor-cable jacket engagement member, a cable engagement member, a clamp driver, a driver component, or any generally annular member configured to compress and/or clamp a coaxial cable 10 and/or an outer conductor 14. Embodiments of the clamp 270 may be a solid, generally annular member having a first end 271 and a second end 272, a generally axial opening therethrough, and an inwardly conically projecting opening proximate or otherwise near the first end 271. Embodiments of a clamp 270 may be a solid clamp having a continuous, uninterrupted revolution across the axial distance of the clamp. However, some embodiments of the clamp 270 may be slotted to provide resiliency. Embodiments of the clamp 270 may be disposed within the outer housing 220, and may be moveable within the outer housing 220. Furthermore, embodiments of the clamp 270 may include an annular ramped surface 278 at the first end 271 which defines an increase in an outer diameter of the clamp 270 from the first end 271 to the second end 272. The inner surface 233 of the outer housing 220 may include an inner surface 233*a* having a smaller inner diameter than inner surface 233*b* proximate or otherwise near the second end 222 of the outer housing 220; the difference in diameter between the inner surface 233*a* and the inner surface 233*b* may be defined by the internal annular lip 229 of the outer housing 220. The inner diameter of the inner surface 233*a* may be slightly larger than the outer diameter of the clamp 70 beyond the annular ramped surface 278. Thus, when the outer housing 220 and the clamp 270 are advanced together, the clamp 270 may initially enter the outer housing 220 but then the increase in outer diameter defined by the annular ramped surface 278 may press-fit the clamp 270 within the outer housing 220.

Embodiments of the clamp 270 may include a first compression surface 273. The first compression surface 273 may be configured to sandwich, pinch, clasp, clamp, secure, retain, etc., the outer conductor 14 of a coaxial cable 10 via cooperation with an opposing, second compression surface 283. The first compression surface 273 may defined by an annular ramped surface 275 that can inwardly project from the first end 271 towards the second end 272. Embodiments of the annular ramped surface 275 may define a gradually decreasing internal diameter from a first diameter proximate or otherwise near the first end 271 to a second, constant or substantially constant diameter between the first end 271 and the second end 272. In other words, the clamp 270 may include an internal opening or passageway defined by a first diameter, that may be tapered, or otherwise conical, an axial distance from the first end 271 to a second, constant, or substantially constant, diameter. Embodiments of the second, constant, diameter may be such that the outer conductor 14 may be engaged at a point where the outer conductor 14 can be pushed up against the annular ramped surface 275 and flared out when the port 200 is being assembled. However, embodiments of clamp 270 may include a third diameter that is defined by an increase in the internal diameter of the clamp 270 proximate or otherwise near the second end 272 to potentially provide clearance for a portion of the cable jacket 12 and/or dielectric 16 as the cable 10 enters the opening of the clamp 270. Furthermore, the clamp 270 may be made of conformal materials, and may be non-conductive. For example, the clamp 270 may be made of plastics, composites, or other insulating material that may form a conformal body. Manufacture of the clamp 270 may include casting, extruding, cutting, turning, drilling, compression molding, injection molding, spraying, or other fabrication methods that may provide efficient production of the component.

Figure 10:
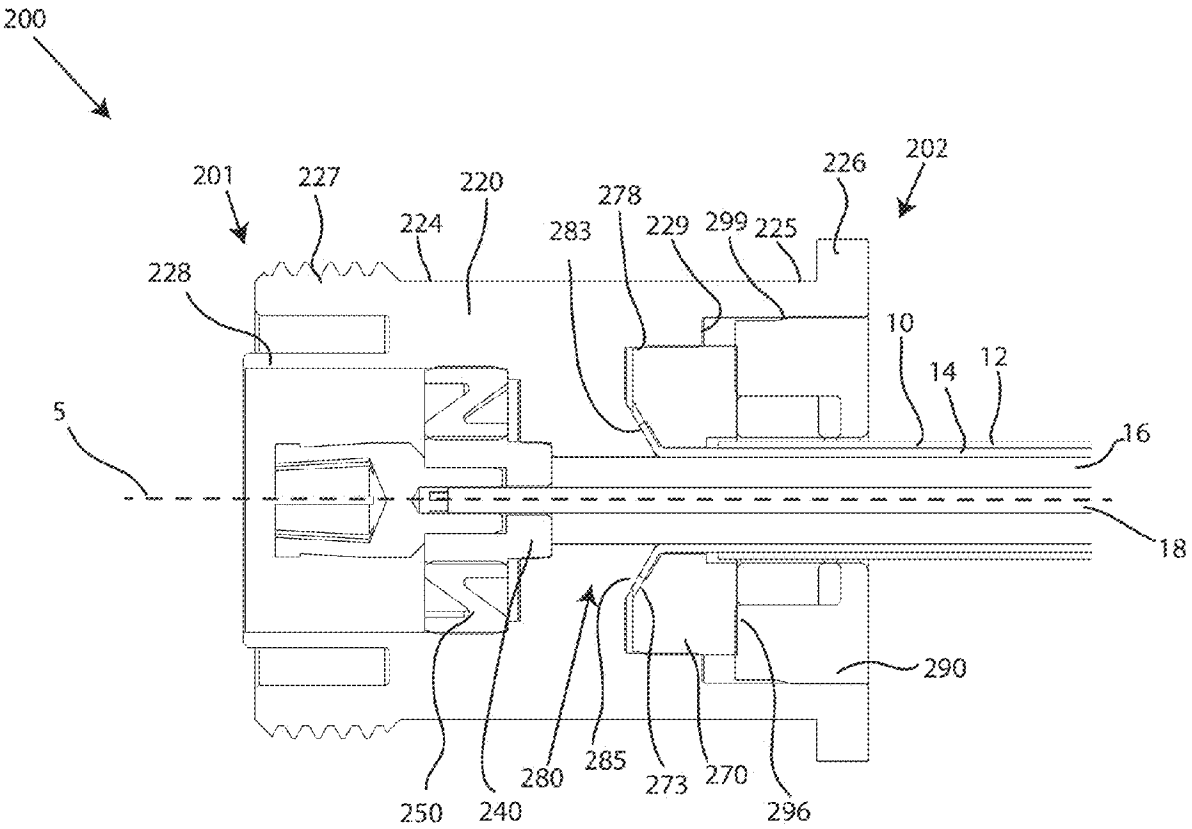
FIG. 10 depicts a cross-sectional view of the second embodiment of the port assembly connector in a closed position.
Figure 11:
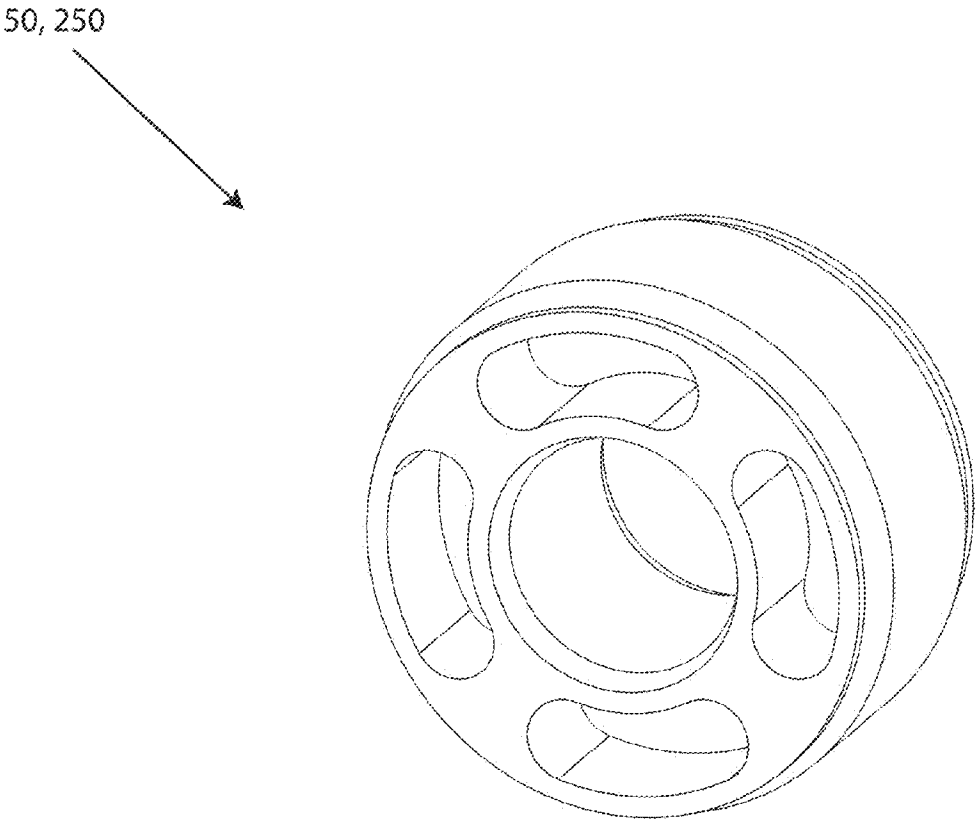
FIG. 11 depicts another embodiment of an insulator body.
Figure 12:
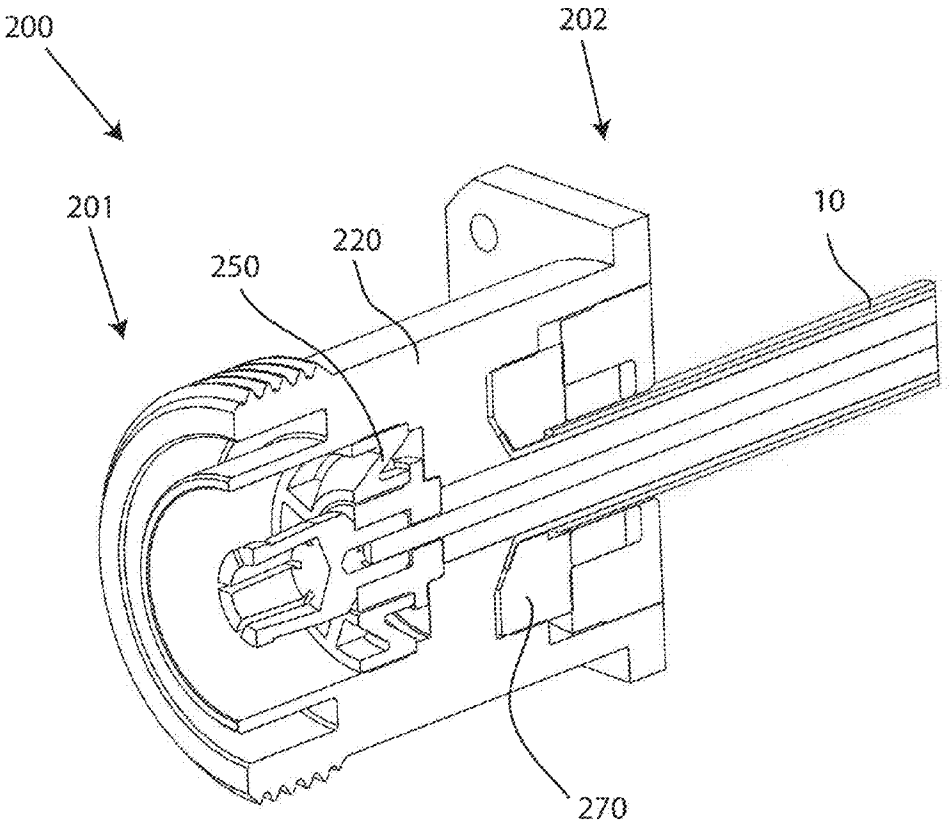
FIG. 12 depicts a cut-away, perspective view of the second embodiment of the port assembly connector.

Embodiments of the port assembly 200 may include an insulator body 250. The insulator body 250 may include a first end 251, a second end 252, an inner surface 253, and an outer surface 254. The insulator body 250 may be disposed within the outer housing 220, wherein the insulator body 250 surrounds or substantially surrounds at least a portion of insert 240. In particular, the insulator body 250 may surround the annular recessed portion 245 of the insert 240, while operably configured. When the insulator body 250 is inserted within the outer housing 220 during assembly, the insulator body 250 may bias the insert 240, or the annular recessed portion 245 into engagement with the socket 230 to facilitate securement of the socket 230. Moreover, the insulator body 250 may include an axially extending opening which may extend from the first end 251 through the second end 252. The opening may be a bore, hole, channel, tunnel, and the like. The insulator body 250, in particular, the opening of the insulator body 250 may accept, receive, accommodate, etc., the electrical socket 230 and the annular recessed portion 245 of the insert 240 while operably configured in a closed position. The insulator body 250 may be disposed within the outer housing 220. For instance, embodiments of the insulator body 250 may be sized and dimensioned to fit within the first end 221 of the outer housing 220, and in most embodiments, to fit within the diameter of the inner collar portion 228 of the outer housing 220; the outer surface 254 of the insulator body 250 may contact the inner surface 223 of the outer housing 220 proximate the inner collar portion 228, while operably configured (e.g. in a assembled configuration or a closed position). Moreover, in an open position, the insulator body 250 may located proximate or otherwise near the first end 21 of the outer housing. Embodiments of the insulator body 250 may include an engagement surface 257. The engagement surface 257 may be a surface of the insulator body 250 that faces the first end 201 of the port assembly 200, and is configured to engage a component(s) of a tool for placement further within the outer housing and into a press-fit relationship with the outer housing 220 and the insert 240, which can exert a radial force against the insert 240 to help retain the socket 230. Embodiments of the insulator body 250 should be made of non-conductive, insulator materials, such as plastic, rubber, and the like. Manufacture of the insulator body 50 may include casting, extruding, cutting, turning, drilling, compression molding, injection molding, spraying, or other fabrication methods that may provide efficient production of the component. Other embodiments of the insulator body 50 may an insulator having a Z-shaped cross-section, as shown in FIG. 10, or an insulator 250 that is a milled insulator plastic body having a plurality of milled pockets, as shown in FIGS. 8 and 9. Additionally, the insulator 250 (and insulator 50) may include alternating ribs to decrease the axial length of the cross-section of the insulator, as shown in FIG. 11. For example, the insulator 250 may include has alternating ribbing to minimize return loss, or a Z-shaped cross section to minimize return loss or has both.

With continued reference to FIGS. 8 and 9, embodiments of the port assembly 200 may include a socket 230. The socket 230 may have a first end 231, a second end 232, an inner surface 233, and an outer surface 234. Embodiments of the socket 230 may be a conductive element that may extend or carry an electrical current and/or signal from a first point to a second point. Embodiments of the socket 230 may be a female receptacle or socket configured to receive a center conductive strand, such as a conductive pin, of a male connector, at the first end 231, and a center conductor 18 of a coaxial cable 10 at the second end 232. The socket 230 may be a conductive center conductor clamp or basket that clamps, grips, collects, receives, or mechanically compresses onto the male conductive pin or center conductive strand 18 of a coaxial cable 10. The socket 230 may further include a first opening 235, wherein the first opening 235 may be an opening, bore, hole, channel, and the like for accepting a center conductive pin or terminal from a matable male connector, and a second opening 236, wherein the second opening 236 may be an opening, bore, hole, channel, and the like, for accepting a center conductive strand 18 of a coaxial cable 10. Additionally, embodiments of the socket 230 may be slotted or otherwise resilient to permit deflection of the socket 30 as conductive strands are received. Embodiments of the socket 230 may be sized and dimensioned to fit within the outer housing 220 proximate or otherwise near the first end 221 of the outer housing 220, and may have an outer diameter sized and dimensioned to fit within the axial opening of the insert 240. Embodiments of the socket 230 should be formed of conductive materials.

Embodiments of the port assembly 200 may also include an insert 240. The insert 240 may include a first end 241 and a second 242, an inner surface 243, and an outer surface 244. Embodiments of the insert 240 may be a generally annular member, having a generally axial opening therethrough, such as a bushing. However, proximate the first end 241 of the insert 240, an annular recessed portion 245 of the insert 240 may surround the second end 232 of the socket 230. Embodiments of the annular recessed portion 245 may facilitate firm physical contact between the socket 230 and the received center conductor 18 of the coaxial cable 10 when the insulator 250 is pressed into the closed position, or fully assembled position. In embodiments where the insert 240 does not include an annular recessed portion 245, and resembles an annular bushing, as shown in FIG. 10, the bushing may surround and bias against the socket 230. In addition, the insert 240 may electrically isolate the socket 230 from the outer housing 220, during the assembled and/or closed positions. Embodiments of the insert 240 may be configured to move within the outer housing 220 upon axial compression; the movement of the insert 240 may be synchronous with the socket 230 as the insulator body 250 is displaced into contact with the insert 240. Embodiments of the insert 240 should be made of non-conductive, insulator materials. Manufacture of the insert 240 may include casting, extruding, cutting, turning, drilling, compression molding, injection molding, spraying, or other fabrication methods that may provide efficient production of the component.

With reference to FIGS. 8-10, embodiments of the port assembly 200 may also include a collar 290. Embodiments of collar 290 may include a first end 291, a second end 292, an inner surface 293, and an outer surface 294. Embodiments of the collar 290 may be a generally annular member having a generally axial opening therethrough. Moreover, embodiments of the collar 290 may be disposed around a sealing element 260 and/or the cable 10. Embodiments of the collar 290 may include an annular ramped surface 299 at the first end 291 which defines an increase in an outer diameter of the collar 290 from the first end 291 to the second end 292. The inner surface 233 of the outer housing 220 may include an inner surface **233*a* having a smaller inner diameter than inner surface 233*b* proximate or otherwise near the second end 222 of the outer housing 220; the difference in diameter between the inner surface 233*a* and the inner surface 233*b* may be defined by the internal annular lip 229 of the outer housing 220. The inner diameter of the inner surface 233*b* may be slightly larger than the outer diameter of the collar 290 beyond the annular ramped surface 299 (toward the second end 292). Thus, when the outer housing 220 and the collar 290 are advanced together, the collar 290 may initially enter the outer housing 220 but then the increase in outer diameter defined by the annular ramped surface 299 may press-fit the collar 290 within the outer housing 220. Furthermore, embodiments of the collar 290 may include an annular recessed portion 296 that may accommodate a flange portion 266 of sealing element 260. Embodiments of the collar 90 may be comprised of conductive materials, such as metal, including but not limited to aluminum. However, embodiments of collar 290** could also be made of a non-conductive material, such as plastic or rubber.

Continuing to refer to FIGS. 8-10, embodiments of the port assembly 200 may include a sealing element 260. FIGS. 8 and 9 depict an embodiment of sealing element 260 that can extend beyond the second end 202 of the outer housing 220 and sealingly engage the cable 10. The sealing element 260 may have a first end 261, a second end 262, an inner surface 263, and an outer surface 264. Moreover, embodiments of the sealing element 260 may include internal annular ribs, such as ribs 265, which may provide strain relief as well as form multiple sealing rings around the cable 10 for efficient environmental sealing. Embodiments of the sealing element may include a flange portion 266 to cooperate with the annular recessed portion 296 of the collar 290. However, other embodiments of the sealing element 260 may not extend beyond the second end 202 of the outer housing 220. For example, FIG. 10 depicts an embodiment of a sealing element 260 disposed within the outer housing 220 and configured to sealing engage the cable 10. Various embodiments of the sealing element 260 may be used for strain relief and sealing of the cable 10, and may incorporate bulk deformation by radial compression of an elastomer, or may incorporate a rubber seal across a length of the cable 10 to sealing engage the cable 10. In some embodiments, the collar 290 may be extended beyond the second end 202 of the port connector 200 to provide strain relief to the cable 10.

Referring still to FIGS. 8-10, and 12, the manner in which port assembly connector 200 may be assembled, and then moved and/or compressed from a first, open position to a second, closed position to secure the outer conductor 14 of cable 10 is now described. The open position may refer to a position or arrangement wherein the port assembly 200 is not fully assembled, and press-fit engagement of one or more components may still be required. Alternatively, the open position may refer to an assembled position, wherein a flared out portion of the outer conductor is not fully secured between the first compression surface 273 and the second compression surface 283. The assembly of the port assembly connector 200 may first involve preparing an end of the cable 10, as described above, and placing the collar 290 over the cable 10 such that the cable 10 extends through the generally axial opening of the collar 290. Then, an installer may place the sealing element 260 and the clamp 270 onto the cable 10. An installer can now prep the outer conductor 14 by flaring it out with the use of a tool, and may press the outer conductor 14 against the annular inwardly projecting surface of the clamp 270. Those skilled in the art should appreciate that a tool used to flare out the outer conductor 14 could encompass various styles and types of tools, and the prep of the outer conductor 14 could potentially be done without the help of a tool. After the outer conductor 14 is prepped and flared out, the installer may place the outer housing onto the cable, wherein the integral compression component 280 may engage the outer conductor 14 to secure the outer conductor 14 between the opposingly conical compression surfaces 273, 283. Next, the installer may place the insert 40 onto the cable 10 within the first end 221 of the outer housing 220, and then the socket 30 may be mated with the center conductor 18 of the cable generally around the recessed portion 245 of the insert 240. Lastly, the installer may insert the insulator body 250 within the collar portion 228 of the outer housing 220. To achieve the closed position, as shown in FIGS. 8-10, an installer may compress or close the second end 202 of the connector assembly 200 by advancing the outer housing 220 towards the clamp 270 and the collar 290, or vice versa. Because of the outer annular ramped surfaces 278, 299 which define a larger diameter than the inner diameter of the outer housing proximate surface 233*a* and 233*b* respectively, the clamp 270 and the collar 290 can be press-fit within the outer housing 220. Consequently, the sealing element 260 may be engaged with the cable 10 upon compression of the collar 290, such that compression at the second end 202 can act as a physical seal of the cable 10. Closing, or compressing, the second end 202 of the port 200 connector may allow the installer to verify an accurate connection of the outer conductor prior to securing connection of the center conductor 18. Moreover, the installer may then compress, or otherwise displace the insulator body 250 further within the outer housing 220 until the insulator body 250 is press-fit within the outer housing 220. Because the other components, such as the insert 40, may each have outer annularly ramped surface that define an increase in an outer diameter, when the insulator body 150 is driven within the outer housing 220 and displacing the other components, the larger outer diameters of the other components can become press-fit within the outer housing 220, and securely retain the components with the post assembly connector 200. The compression at the first end 201 of the insulator 250 may act as a physical seal against the cable 10. Accordingly, the port assembly connector 200 can be separately compressed to a closed position in more than a single, compressive action; the end 201 and 202 are separately compressible. For instance, the installer may compress the second end 202 of the connector 202, and then, a second action by the installer can be required to close the second end 202. Those having skill in the art should appreciate that the first end 201 may be closed prior to the second end 202 if needed.

A method of securing an outer conductor 14 may include the steps of providing port assembly connector 100, 200 comprising an outer housing 20, 220 having a first end 21, 221 and a second end 22, 222, wherein the outer housing 20, 220 is configured to receive a coaxial cable 10 through the second end 222, a clamp 70, 270 disposed within the outer housing 20, 220, the clamp 70, 270 including a first compression surface 73, 273, and a second compression surface 83, 283, wherein the second compression surface 83, 283 opposingly corresponds to the first compression surface 73, 273, flaring out the outer conductor 14, securing the outer conductor 14 between the first compression surface 73, 273, and the second compression surface 83, 283, compressing a second end 2, 202 of the port connector 100, 200, and separately compressing a first end 1, 201 of the port connector 100, 200.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A port assembly comprising:

an outer housing having a first end and a second end, wherein the outer housing is configured to receive a coaxial cable through the second end, wherein the outer housing is configured to mate with a coupling member of a corresponding coaxial cable connector;

a socket disposed within the outer housing, the socket configured to accept a center conductor of the coaxial cable;

an insert disposed within the outer housing, the insert configured to receive a portion of the socket;

an insulator body disposed within the outer housing, the insulator body positioned to bias the insert into engagement with the socket;

a clamp disposed within the outer housing, the clamp including a first compression surface;

a second compression surface, wherein the second compression surface opposingly corresponds to the first compression surface; and wherein the first compression surface and the second compression surface cooperate via axial compression to secure an outer conductor of the coaxial cable.

2. The port assembly of claim 1, wherein the second compression surface is a conductive compression component disposed within the outer housing.

3. The port assembly of claim 1, wherein the second compression surface is an integral portion of the outer housing.

4. The port assembly of claim 1, wherein the insert is an insulator.

5. The port assembly of claim 1, wherein the first compression surface is an inwardly extending ramped surface.

6. The port assembly of claim 1, wherein the clamp has a continuous, uninterrupted revolution across an axial distance of the clamp.

7. The port assembly of claim 1, wherein the clamp is slotted.

8. The port assembly of claim 1, wherein the clamp engages a portion of an outer conductor of the coaxial cable and a portion of a cable jacket of the coaxial cable when in an open position.

9. The port assembly of claim 1, wherein the second compression surface an outwardly protruding ramped surface.

10. The port assembly of claim 1, wherein at least one of the first compression surface and the second compression surface is non-conductive and made from a conformal material.

11. The port assembly of claim 1, further comprising a seal member disposed around the coaxial cable proximate the second end of the outer housing.

12. A bulkhead connector for an equipment port comprising:

an outer housing having a first end and a second end, wherein the outer housing is configured to receive a coaxial cable through the second end, wherein the outer housing is configured to mate with a coupling member of a corresponding coaxial cable connector;

a clamp having a first end and a second end, the clamp having a first compression surface defined by a gradually decreasing inner diameter from the first end toward the second end, wherein the clamp is configured to engage the coaxial cable in an open position of the bulkhead connector; and a second compression surface disposed within the outer housing, the second compression surface having a conical shaped protrusion configured to opposingly correspond with the first compression surface;

a socket disposed within the outer housing, the socket configured to accept a center conductor of the coaxial cable;

an insert disposed within the outer housing, the insert configured to receive a portion of the socket;

an insulator body disposed within the outer housing, the insulator body positioned to bias the insert into engagement with the socket;

wherein the second compression surface is axially slidably advanced into contact with a portion of an outer conductor of the coaxial cable to achieve a closed position of the bulkhead connector.

13. The bulkhead connector of claim 12, wherein:

the insulator body is configured to be axially compressed to apply radial pressure to a portion of the insert, the portion of the insert thereby applying radial pressure to a portion of the socket; and the second compression surface is a compression component disposed within the outer housing.

14. The bulkhead connector of claim 12, wherein the second compression surface is an integral portion of the outer housing.

15. The bulkhead connector of claim 12, wherein the outer conductor of the coaxial cable is secured between the first compression surface and the second compression surface when the bulkhead connector is in the closed position.

16. The bulkhead connector of claim 12, wherein:

at least one of the first compression surface and the second compression surface is non-conductive and made from a conformal material; and the second compression surface does not secure a flared out portion of an outer conductor of the coaxial cable in the open position.

17. A port assembly comprising:

a housing having a first end and a second end, wherein the housing is configured to:

receive a coaxial cable through the second end, the coaxial cable having an inner conductor and an outer conductor surrounding the inner conductor; and mate with a coupler of a coaxial cable connector that is attached to the coaxial cable;

a socket configured to be positioned at least partially within the housing, the socket configured to receive at least a portion of the inner conductor of the coaxial cable;

a plurality of cooperating insulators configured to be positioned within the housing, wherein one of the plurality of cooperating insulators has an insulator portion configured to receive a portion of the socket, wherein the plurality of cooperating insulators are configured to cooperate to cause the insulator portion to engage, and apply a radial force to, the socket; and a plurality of cooperating compression surfaces configured to be positioned within the housing, wherein the plurality of cooperating compression surfaces are configured to clamp, and apply an axial force to, a portion of the outer conductor of the coaxial cable.

18. The port assembly of claim 17, wherein:

a first one of the cooperating insulators is an insert having a step-shaped exterior, the insulator portion including a tubular shape having a first diameter, the insert having a second portion with a second diameter that is greater than the first diameter; and a first one of the cooperating compression surfaces is a portion of a compression component configured to be axially moved relative to the housing.

19. The port assembly of claim 18, wherein:

the socket has a plurality of fingers;

a second one of the cooperating insulators is configured to receive the insulator portion so as to cause the fingers to move radially inward; and a second one of the cooperating compression surfaces is integral with the housing.

20. The port assembly of claim 19, further comprising a seal member configured to receive the coaxial cable to create an environmental seal proximate the second end of the housing.

* * * * *